US010878767B2

(12) United States Patent
Morita

(10) Patent No.: US 10,878,767 B2
(45) Date of Patent: Dec. 29, 2020

(54) DISPLAY DRIVER, ELECTRO-OPTICAL DEVICE, AND ELECTRONIC APPARATUS

(71) Applicant: SEIKO EPSON CORPORATION, Tokyo (JP)

(72) Inventor: Akira Morita, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 9 days.

(21) Appl. No.: 16/136,708

(22) Filed: Sep. 20, 2018

(65) Prior Publication Data

US 2019/0088229 A1 Mar. 21, 2019

(30) Foreign Application Priority Data

Sep. 21, 2017 (JP) ..... 2017-181068

(51) Int. Cl.
*G09G 3/36* (2006.01)
*G09G 3/20* (2006.01)

(52) U.S. Cl.
CPC ..... *G09G 3/3688* (2013.01); *G09G 3/20* (2013.01); *G09G 3/3696* (2013.01); *G09G 2310/027* (2013.01); *G09G 2320/0252* (2013.01)

(58) Field of Classification Search
CPC ..... G09G 3/3688; G09G 3/3696; G09G 2310/027; G09G 2320/0252
See application file for complete search history.

(56) References Cited

U.S. PATENT DOCUMENTS

| | | | | |
|---|---|---|---|---|
| 6,014,122 | A | 1/2000 | Hashimoto | |
| 2002/0126106 | A1* | 9/2002 | Naito | G09G 3/3648 345/204 |
| 2008/0303770 | A1 | 12/2008 | Oke et al. | |
| 2015/0049073 | A1 | 2/2015 | Morita | |
| 2016/0111035 | A1 | 4/2016 | Morita | |
| 2016/0133218 | A1 | 5/2016 | Morita | |
| 2016/0133219 | A1 | 5/2016 | Morita | |
| 2017/0337891 | A1 | 11/2017 | Morita | |

FOREIGN PATENT DOCUMENTS

| | | | |
|---|---|---|---|
| JP | S56-162535 | A | 12/1981 |
| JP | H04-55889 | A | 2/1992 |
| JP | H10-260664 | A | 9/1998 |
| JP | 2001-67047 | A | 3/2001 |
| JP | 2005-292856 | A | 10/2005 |
| JP | 2008-304806 | A | 12/2008 |

(Continued)

*Primary Examiner* — Shaheda A Abdin
(74) *Attorney, Agent, or Firm* — Oliff PLC

(57) ABSTRACT

A display driver includes a D/A converter circuit configured to convert display data into a gradation voltage, an amplifier circuit including an input node to which the gradation voltage is input and configured to output data voltage, and a supply circuit configured to supply an auxiliary current or an auxiliary electrical charge to the input node of the amplifier circuit. In an auxiliary period, an output of the D/A converter circuit is in a high impedance state, and the supply circuit supplies the auxiliary current or the auxiliary electrical charge to the input node of the amplifier circuit. In a non-auxiliary period after the auxiliary period, the D/A converter circuit outputs the gradation voltage to the input node of the amplifier circuit.

20 Claims, 16 Drawing Sheets

(56) References Cited

FOREIGN PATENT DOCUMENTS

| | | | |
|---|---|---|---|
| JP | 2015-038543 | A | 2/2015 |
| JP | 2016-80807 | A | 5/2016 |
| JP | 2016-90881 | A | 5/2016 |
| JP | 2016-90882 | A | 5/2016 |
| JP | 2017-156769 | A | 9/2017 |

* cited by examiner

DISPLAY DRIVER, ELECTRO-OPTICAL DEVICE, AND ELECTRONIC APPARATUS

The present application is based on and claims priority from JP Application Serial Number 2017-181068, filed Sep. 21, 2017, the disclosure of which is hereby incorporated by reference herein in its entirety.

BACKGROUND

1. Technical Field

The disclosure relates to a display driver, an electro-optical device, and an electronic apparatus.

2. Related Art

A display driver that drives an electro-optical panel includes a ladder resistance circuit that generates a plurality of voltages, a D/A (digital-to-analog) converter circuit that selects a gradation voltage corresponding to display data from the plurality of voltages, and an amplifier circuit that amplifies or buffers (performs impedance conversion on) the gradation voltage. A related technology of such a display driver is disclosed in, for example, JP-A-2005-292856, JP-A-2001-67047, and JP-A-10-260664.

In JP-A-2005-292856, an amplifier circuit is formed of a forward amplifier circuit. In other words, a gradation voltage is input to a noninverting input terminal (positive terminal) of an operational amplifier, and a feedback voltage is input to an inverting input terminal (negative terminal).

In JP-A-2001-67047 and JP-A-10-260664, an amplifier circuit is formed of an inverting amplifier circuit. A first capacitor is provided between an input node of the inverting amplifier circuit and an inverting input terminal of an operational amplifier. A second capacitor is provided between the inverting input terminal of the operational amplifier and an output terminal. A gradation voltage is input to a noninverting input terminal of the operational amplifier.

In recent years, high definition and a high frame rate of an electro-optical panel is desired for a display driver to drive a pixel at high speed within a short driving period. Thus, an amplifier circuit is configured by an operational amplifier having a high-speed response characteristic (having a high through rate and high sensitivity, for example), and the amplifier circuit is configured to be capable of changing a data voltage at high speed. However, even when a speed of an output side of the amplifier circuit is increased, whereas a speed of an input side is not increased accordingly, a pixel may not be driven at high speed. In other words, a voltage change in an input node of the amplifier circuit (i.e., a voltage change in a gradation voltage output from the D/A converter circuit) desirably speeds up in accordance with an ability of the amplifier circuit to change a data voltage at high speed.

SUMMARY

According to some aspects of the disclosure, a display driver, an electro-optical device, an electronic apparatus, and the like capable of speeding up a voltage change of an input node of an amplifier circuit that outputs data voltage are provided.

One aspect of the disclosure includes a D/A converter circuit configured to convert display data into a gradation voltage, an amplifier circuit configured to be input with the gradation voltage at an input node and output data voltage, and a supply circuit configured to supply an auxiliary current or an auxiliary electrical charge to the input node of the amplifier circuit. One aspect of the disclosure is related to a display driver in which, in an auxiliary period, an output of the D/A converter circuit is in a high impedance state, and the supply circuit supplies the auxiliary current or the auxiliary electrical charge to the input node of the amplifier circuit, and, in a non-auxiliary period after the auxiliary period, the D/A converter circuit outputs the gradation voltage to the input node of the amplifier circuit.

According to one aspect of the disclosure, the auxiliary current or the auxiliary electrical charge is supplied to the input node of the amplifier circuit in the auxiliary period, and thus a capacity (for example, parasite capacity) of the input node of the amplifier circuit is charged with the auxiliary current or the auxiliary electrical charge. Thus, a voltage of the input node of the amplifier circuit can change to the gradation voltage (or a voltage in the vicinity) to be output from the D/A converter circuit in the non-auxiliary period at high speed.

In one aspect of the disclosure, the amplifier circuit may include an operational amplifier configured to be input with a reference voltage at a noninverting input terminal, a first resistor provided between the input node to which the gradation voltage is input and an inverting input terminal of the operational amplifier, and a second resistor provided between an output terminal of the operational amplifier and the inverting input terminal.

In this way, there are various advantages in contrast to advantages in a case where a noninverting amplifier circuit, an amplifier circuit using a capacitor as a feedback circuit, and the like is adopted. For example, an operating point of a differential pair of the operational amplifier is limited to the vicinity of a reference voltage, and thus the operational amplifier can be made to be highly sensitive (or highly gained). Alternatively, initialization is not needed unlike an inverting amplifier circuit using a capacitor as a feedback circuit.

In one aspect of the disclosure, the supply circuit may include first to n-th capacitors (n is an integer of two or greater) with first ends coupled to the input node, and first to n-th buffers configured to output first to n-th voltages to second ends of the first to n-th capacitors by input data based on the display data, and, in the auxiliary period, the first to n-th buffers may respectively output the first to n-th voltages, and the auxiliary electrical charge may be supplied from the first ends of the first to n-th capacitors to the input node.

In this way, the first to n-th buffers output the first to n-th voltages to the second ends of the first to n-th capacitors by the input data based on the display data, and thus the auxiliary electrical charge can be supplied from the first ends of the first to n-th capacitors to the input node of the amplifier circuit. A voltage change by redistributing an electrical charge can be achieved at a speed higher than a speed at which the voltage of the input node of the amplifier circuit changes. Thus, the voltage of the input node of the amplifier circuit can change at a high speed in the auxiliary period.

In one aspect of the disclosure, the display driver further may include an arithmetic circuit configured to compute the input data, based on the display data, and output the input data to the first to n-th buffers.

In this way, the input data is computed based on the display data. Thus, the input data that achieves a target voltage corresponding to the gradation voltage can be supplied to the first to n-th buffers. Thus, the auxiliary electrical charge for changing the voltage of the input node of the amplifier circuit to the target voltage corresponding to the gradation voltage can be supplied to the input node of the amplifier circuit from the first ends of the first to n-th capacitors.

In one aspect of the disclosure, the supply circuit may include a first current supply circuit provided between a node of a high electric potential side-power supply voltage and the input node and configured to pass the auxiliary current from the node of the high electric potential side-power supply voltage to the input node in the auxiliary period, and a second current supply circuit provided between a node of a low electric potential side-power supply voltage and the input node and configured to pass the auxiliary current from the input node to the node of the low electric potential side-power supply voltage in the auxiliary period.

In this way, in the auxiliary period, the first current supply circuit passes a first auxiliary current from the node of the high electric potential side-power supply voltage to the input node of the amplifier circuit, or the second current supply circuit passes a second auxiliary current from the input node of the amplifier circuit to the node of the low electric potential side-power supply voltage. Thus, a capacity of the input node of the amplifier circuit can be charged. A voltage change by supplying a current can be achieved at a speed higher than a speed at which the D/A converter circuit changes the voltage of the input node of the amplifier circuit. Thus, the voltage of the input node of the amplifier circuit can change at a high speed in the auxiliary period.

In one aspect of the disclosure, the amplifier circuit may include an operational amplifier configured to be input with a reference voltage at a noninverting input terminal, a first resistor provided between the input node to which the gradation voltage is input and an inverting input terminal of the operational amplifier, and a second resistor provided between an output terminal of the operational amplifier and the inverting input terminal, the first current supply circuit may pass a first compensation current from the node of the high electric potential side-power supply voltage to the input node of the amplifier circuit in the non-auxiliary period, and the second current supply circuit may pass a second compensation current from the input node of the amplifier circuit to the node of the low electric potential side-power supply voltage in the non-auxiliary period.

The first current supply circuit passes the first compensation current from the node of the high electric potential side-power supply voltage to the input node of the amplifier circuit, and the second current supply circuit passes the second compensation current from the input node of the amplifier circuit to the node of the low electric potential side-power supply voltage. Thus, the current flowing between the input node of the amplifier circuit and the ladder resistance circuit through the D/A converter circuit can be compensated (reduced or canceled). Thus, while the inverting amplifier circuit including the first and second resistors provided as feedback circuits between the input node and the output node is adopted, an error in the gradation voltage output from the D/A converter circuit can be reduced (or canceled).

In one aspect of the disclosure, the D/A converter circuit may include a switch group configured to select any of a plurality of voltages as the gradation voltage, and a control circuit configured to control the switch group, based on the display data, and the control circuit may turn off switches of the switch group to set an output of the D/A converter circuit to the high impedance state in the auxiliary period.

In this way, the control circuit turns off the switches of the switch group in the auxiliary period, and thus the output of the D/A converter circuit can be set in the high impedance state. This can prevent the auxiliary current or the auxiliary electrical charge from flowing to the ladder resistance circuit through the D/A converter circuit in the auxiliary period. In other words, it is possible to prevent an error in a gradation voltage at the end of the auxiliary period from occurring.

Another aspect of the disclosure is related to an electro-optical device including any of the display drivers described above, and an electro-optical panel driven by the display driver.

Still another aspect of the disclosure is related to an electronic apparatus including any of the display drivers described above.

BRIEF DESCRIPTION OF THE DRAWINGS

Embodiments of the disclosure will be described with reference to the accompanying drawings, wherein like numbers reference like elements.

DESCRIPTION OF EXEMPLARY EMBODIMENTS

Hereinafter, some exemplary embodiments of the disclosure will be described in detail. Note that some exemplary embodiments described below do not unreasonably limit contents of the disclosure described in claims, and all configurations described in some exemplary embodiments do not have to be indispensable matters of the disclosure.

1. Display Driver

Figure 1:
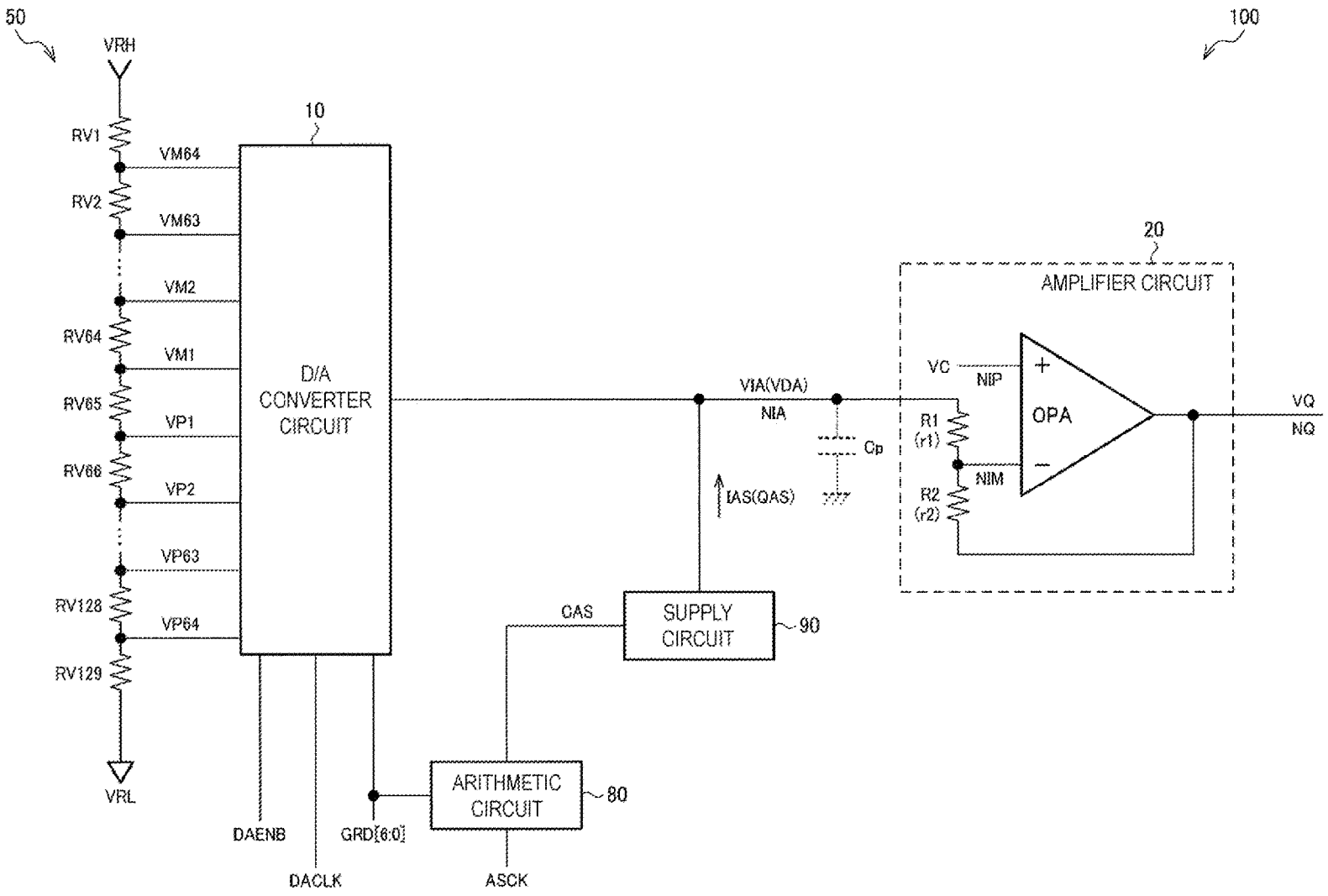
FIG. 1 is an example of a configuration of a display driver in the exemplary embodiment.

FIG. 1 is an example of a configuration of a display driver 100 in one exemplary embodiment. The display driver 100 includes a D/A converter circuit 10, an amplifier circuit 20, and a supply circuit 90. The display driver 100 can also include a ladder resistance circuit 50 (gradation voltage generating circuit) and an arithmetic circuit 80 (second arithmetic circuit, control circuit). The display driver 100 is configured by, for example, an integrated circuit (IC) device. Note that the disclosure is not limited to the configuration of FIG. 1, and various modifications can be achieved by, for example, omitting a part of the components or adding another component.

The ladder resistance circuit 50 includes resistors RV1 to RV129 (resistance elements) coupled in series. A high electric potential side-power supply voltage VRH is input to one end on the resistor RV1 side of the resistors RV1 to RV129 coupled in series. A low electric potential side-power supply voltage VRL is input to the other end on the resistor RV129 side. Voltages VP1 to VP64 and VM1 to VM64 are each output from a node (tap) between a resistor and a resistor of the ladder resistance circuit 50. In other words, the voltage VM64 is output from the node between the resistor RV1 and the resistor RV2. The voltage VM63 is output from the node between the resistor RV2 and the resistor RV3. The voltage VM1 is output from the node between the resistor RV64 and the resistor RV65. The voltage VP1 is output from the node between the resistor RV65 and the resistor RV66. The voltage VP2 is output from the node between the resistor RV66 and the resistor RV67. The voltage VP64 is output from the node between the resistor RV128 and the resistor RV129. For example, the resistors RV2 to RV128 have the same resistance value. Note that this is not restrictive, and, for example, the resistors RV2 to RV65 may have a resistance value corresponding to a gamma characteristic of negative-polarity driving, and the resistors RV66 to RV128 may have a resistance value corresponding to a gamma characteristic of positive-polarity driving.

The D/A converter circuit 10 converts display data GRD [6:0] into a gradation voltage VDA. On the assumption that a voltage of an input node NIA of the amplifier circuit 20 is VIA, VIA=VDA when the D/A converter circuit 10 outputs the gradation voltage VDA. The D/A converter circuit 10 selects a voltage corresponding to the display data GRD [6:0] from the plurality of voltages VP1 to VP64 and VM1 to VM64 and outputs the selected voltage as the gradation voltage VDA. Specifically, when GRD [6:0]=0000000, 0000001, . . . , 0111111, respective negative-polarity driving voltages VM64, VM63, VM1 are output as the gradation voltage VDA. When GRD [6:0]=1000000, 1000001, . . . , 1111111, respective positive-polarity driving voltages VP1, VP2, VP64 are output as the gradation voltage VDA. Note that GRD [6:0] is expressed in binary herein. In polarity inversion driving that inverts a drive polarity for every pixel, line, or frame, the positive-polarity driving voltages VP1 to VP64 are selected for the positive-polarity driving, and the negative-polarity driving voltages VM1 to VM64 are selected for the negative-polarity driving.

The gradation voltage VDA is input to the input node NIA of the amplifier circuit 20, and the amplifier circuit 20 outputs data voltage (output voltage VQ). In other words, the amplifier circuit 20 amplifies or buffers (performs the impedance conversion on) the gradation voltage VDA input as the voltage VIA of the input node NIA, and then outputs the output voltage VQ to an output node NQ. The output voltage VQ is output as data voltage from a terminal (pad or package terminal) of the display driver 100, and drives a data line (source line) of an electro-optical panel coupled to the display driver 100. For example, the amplifier circuit 20 is an inverting amplifier circuit that inverts and amplifies the gradation voltage VDA with a reference voltage VC as a reference. For example, when VP64<VP63< . . . <VP1=VC<VM1<VM2< . . . <VM64, the negative-polarity driving voltages VM1 to VM64 are data voltages having a negative polarity lower than the reference voltage VC by the inversion amplification, and the positive-polarity driving voltages VP1 to VP64 are data voltages having a positive polarity higher than the reference voltage VC by the inversion amplification.

The supply circuit 90 supplies an auxiliary current IAS or an auxiliary electrical charge QAS to the input node NIA of the amplifier circuit 20. Specifically, the supply circuit 90 changes the voltage VIA of the input node NIA to a target voltage by charging a capacity of the input node NIA (for example, a capacity of wiring and a parasitic capacity such as a capacity between a source and a gate (drain-to-gate capacity) of a transistor) with the auxiliary current IAS or the auxiliary electrical charge QAS. The target voltage is, for example, the gradation voltage VDA to be output from the D/A converter circuit 10 or a voltage within a given voltage range including the gradation voltage VDA (for example, a voltage corresponding to high-order bit data of the display data GRD [6:0] corresponding to the gradation voltage VDA). To increase the voltage VIA of the input node NIA, the supply circuit 90 supplies a positive auxiliary current IAS or a positive auxiliary electrical charge QAS to the input node NIA. To reduce the voltage VIA of the input node NIA, the supply circuit 90 supplies a negative auxiliary current IAS or a negative electrical charge QAS to the input node NIA.

Figure 2:
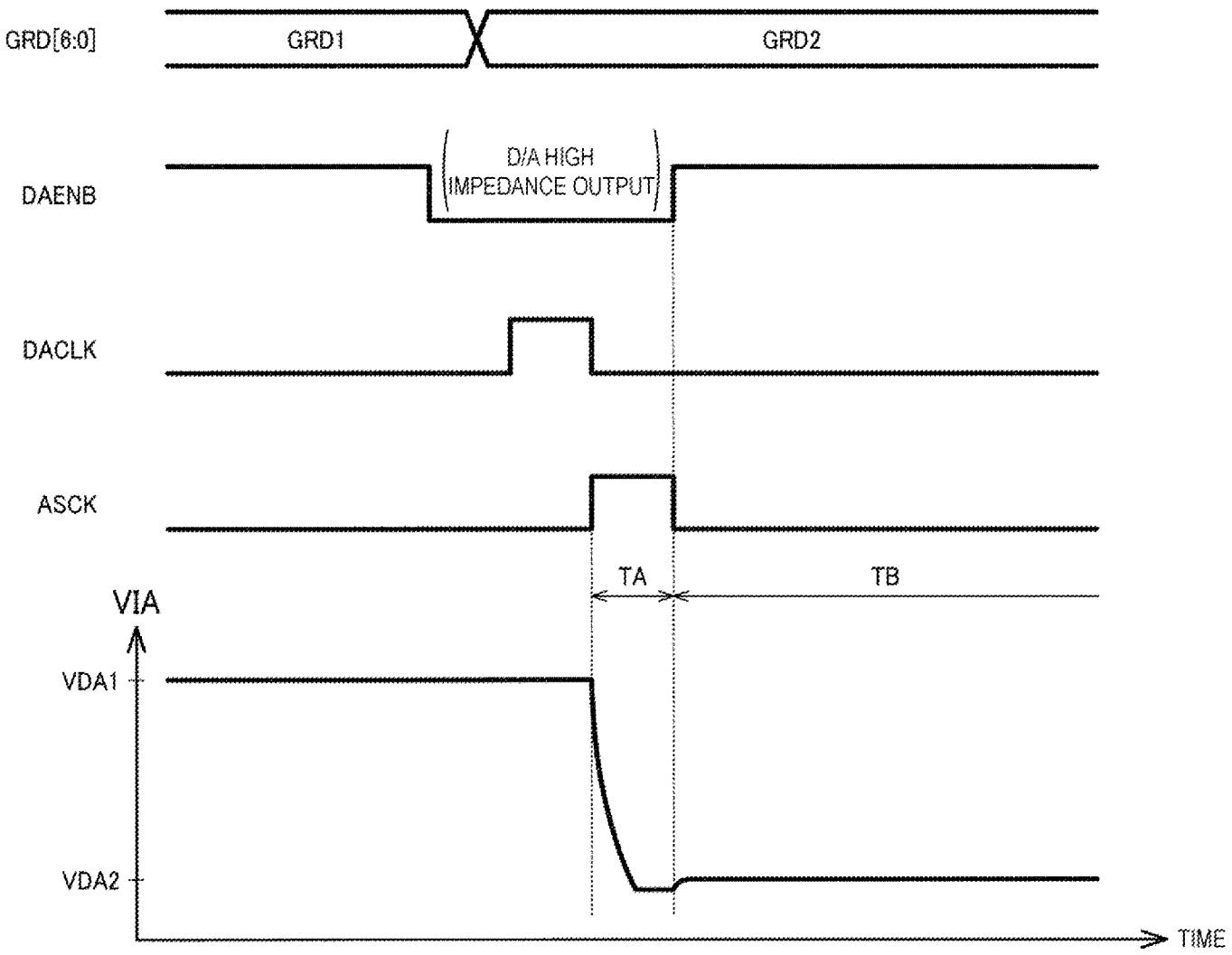
FIG. 2 is a timing chart for describing an operation of the display driver in the exemplary embodiment.

FIG. 2 is a timing chart for describing an operation of the display driver 100 in one exemplary embodiment. As illustrated in FIG. 2, in an auxiliary period TA (first period), an output of the D/A converter circuit 10 is in a high impedance state, and the supply circuit 90 supplies the auxiliary current IAS or the auxiliary electrical charge QAS to the input node NIA of the amplifier circuit 20. Then, the D/A converter circuit 10 outputs the gradation voltage VDA to the input node NIA of the amplifier circuit 20 in a non-auxiliary period TB (second period) after the auxiliary period TA.

Specifically, the amplifier circuit 20 drives a plurality of pixels (a plurality of source lines) in a time-division manner in a horizontal scanning period. In FIG. 2, the display data GRD [6:0]=GRD1 corresponding to a gradation voltage VDA1 that writes a first pixel is input to the D/A converter circuit 10 while the display data GRD [6:0]=GRD2 corresponding to a gradation voltage VDA2 that writes a second pixel is input to the D/A converter circuit 10.

An enable signal DAENB is a signal for controlling output enable of the D/A converter circuit 10. For example, when the enable signal DAENB is at a low level (first logical level, non-active), the output of the D/A converter circuit 10 is in a high impedance state. When the enable signal DAENB is at a high level (second logical level, active), the output of the D/A converter circuit 10 is enabled. The enable signal DAENB is at the low level in a period including timing at which the display data GRD [6:0] is changed. The output of the D/A converter circuit 10 is in the high impedance state in the period.

A clock signal DACLK is a signal for causing the D/A converter circuit 10 to latch (take in) the display data GRD [6:0]. The D/A converter circuit 10 latches the display data GRD [6:0] at a rising edge (edge in a broad sense) of the clock signal DACLK after the timing at which the display data GRD [6:0] is changed, and then converts the latched display data GRD [6:0] from digital to analog.

The auxiliary period TA is included in the period in which the output of the D/A converter circuit 10 is in the high impedance state. Specifically, the auxiliary period TA starts after the timing at which the display data GRD [6:0] is changed and ends before the timing at which the output of the D/A converter circuit 10 is enabled. More specifically, the arithmetic circuit 80 generates setting data CAS (control signal) for controlling a current value of the auxiliary current IAS or an amount of electrical charge of the auxiliary electrical charge QAS, based on the display data GRD [6:0], and outputs the setting data CAS to the supply circuit 90. For example, the setting data CAS for controlling a current value of the auxiliary current IAS is generated based on a difference between the display data GRD2 this time and the display data GRD1 the last time. Alternatively, the setting data CAS for controlling an amount of electrical charge of the auxiliary electrical charge QAS is generated based on the display data GRD2 corresponding to the target voltage. The arithmetic circuit 80 changes the setting data CAS at a falling edge of a signal ASCK. The auxiliary period TA is a period defined by the signal ASCK. For example, a period in which the signal ASCK is at the high level (second logical level, active) is the auxiliary period TA. Alternatively, a period from the falling edge of the signal ASCK to the timing at which the output of the D/A converter circuit 10 is enabled is the auxiliary period TA. Note that a relationship between the timing for changing the clock signal DACLK and the auxiliary period TA is not limited to FIG. 2.

The voltage VIA of the input node NIA of the amplifier circuit 20 before the auxiliary period TA is the gradation voltage VDA1 corresponding to the display data GRD1. In the auxiliary period TA, the output of the D/A converter circuit 10 is in the high impedance state, and the supply circuit 90 supplies the auxiliary current IAS or the auxiliary electrical charge QAS to the input node NIA of the amplifier circuit 20. In a case where a capacity (parasite capacity) of the input node NIA is Cp, the supply circuit 90 outputs the auxiliary current IAS or the auxiliary electrical charge QAS such that an amount of electrical charge supplied by the auxiliary current IAS or the auxiliary electrical charge QAS is Cp×(VDA2−VDA1) (or is an amount of electrical charge within a given range from the amount of electrical charge). Therefore, the voltage VIA of the input node NIA changes to the gradation voltage VDA2 (or a voltage in the vicinity) corresponding to the display data GRD [6:0]. The output of the D/A converter circuit 10 is enabled in the non-auxiliary period TB, and thus the voltage VIA of the input node NIA is the gradation voltage VDA2 by the gradation voltage VDA2 output from the D/A converter circuit 10.

Note that the arithmetic circuit 80 is realized by a logic circuit. Note that the arithmetic circuit 80 may also be realized by a digital signal processor (DSP) that executes a plurality of processes of digital signal processing in the time-division manner. In this case, arithmetic processing is executed in the time-division manner together with other digital signal processing.

According to the exemplary embodiment above, the auxiliary current IAS or the auxiliary electrical charge QAS is supplied to the input node NIA of the amplifier circuit 20 in the auxiliary period TA. Thus, the capacity of the input node NIA is charged with the auxiliary current IAS or the auxiliary electrical charge QAS, and the voltage VIA of the input node NIA can change to the target voltage (voltage in the vicinity of the gradation voltage VDA2). Accordingly, the voltage VIA of the input node NIA of the amplifier circuit 20 can change to the gradation voltage VDA2 (or a voltage in the vicinity) to be output from the D/A converter circuit 10 in the non-auxiliary period TB at high speed.

Specifically, the D/A converter circuit 10 selects a voltage corresponding to the display data GRD [6:0] from the plurality of voltages VP1 to VP64 and VM1 to VM64 generated by the ladder resistance circuit 50 and outputs the selected voltage as the gradation voltage VDA. At this time, a time constant with which the voltage VIA of the input node NIA changes to the gradation voltage VDA is determined by a resistance value of the ladder resistance circuit 50, a resistance value of a switch of the D/A converter circuit 10, and a capacitance value of the input node NIA of the amplifier circuit 20. The ladder resistance circuit 50 is provided to be shared by the plurality of amplifier circuits, so that a capacity of an input node of each of the plurality of amplifier circuits needs to be charged. According to one exemplary embodiment, the auxiliary current IAS or the auxiliary electrical charge QAS is supplied to the input node NIA of the amplifier circuit 20 in the auxiliary period TA. Thus, the voltage VIA of the input node NIA can approach the gradation voltage VDA for a period of time (with a time constant) shorter than with the above-described time constant. Further, the supply circuit 90 is provided for the input node NIA of one amplifier circuit 20. Thus, the supply circuit 90 can change the voltage VIA of the input node NIA at a higher speed than the ladder resistance circuit 50 provided to be shared by the plurality of amplifier circuits.

In one exemplary embodiment, the amplifier circuit 20 includes an operational amplifier OPA (Op amp), a resistor R1 (first resistor, first resistance element), and a resistor R2 (second resistor, second resistance element). The reference voltage VC is input to a noninverting input terminal (positive terminal, noninverting input node NIP) of the operational amplifier OPA. The resistor R1 is provided between the input node NIA to which the gradation voltage VDA is input and an inverting input terminal (negative terminal, inverting input node NIM) of the operational amplifier OPA. The resistor R2 is provided between an output node of the operational amplifier OPA (output node NQ of the amplifier circuit 20) and the inverting input terminal of the operational amplifier OPA. On the assumption that the resistors R1 and R2 respectively have resistance values r1 and r2, the amplifier circuit 20 inverts and amplifies the gradation voltage VDA by a gain (−r2/r1) and outputs the output voltage VQ.

Adopting the inverting amplifier circuit as the amplifier circuit 20 in such a manner limits an operating point of a differential pair of the operational amplifier OPA to the reference voltage VC (voltage in the vicinity of the reference voltage VC). This eliminates a need to secure sensitivity (gain) of the operational amplifier OPA in an extensive input voltage, and the operational amplifier OPA can thus be made to be highly sensitive (highly gained). The inverting amplifier circuit including the resistors R1 and R2 provided as feedback circuits between the input node NIA and the output node NQ is adopted, and thus a need for initialization is eliminated unlike an inverting amplifier circuit including a capacitor as a feedback circuit. The inverting amplifier circuit is also less affected by an influence of noise than an inverting amplifier circuit including a capacitor as a feedback circuit. Adopting the inverting amplifier circuit improves a frequency response characteristic (expands a band) in comparison with a case where a voltage follower circuit is used for an output of a data voltage. The reason is that a phase of the output is rotated 180 degrees with respect to a phase of the input and a band that can secure a phase margin is thus expanded.

Note that the case where the amplifier circuit 20 is an inverting amplifier circuit is described as an example in the exemplary embodiment above, but this is not restrictive. The amplifier circuit 20 may be a noninverting amplifier circuit (forward amplifier circuit) such as a voltage follower circuit. In this case, the voltages VP1 to VP64 are negative-polarity driving voltages corresponding to the display data GRD [6:0]=0000000 to 0111111 while the voltages VM1 to VM64 are positive-polarity driving voltages corresponding to the display data GRD [6:0]=1000000 to 1111111. In other words, a voltage polarity of the input node NIA of the amplifier circuit 20 is inverted from a voltage polarity in the inverting amplifier circuit, and thus a polarity (positive or negative) of the auxiliary current IAS or the auxiliary electrical charge QAS set based on the display data GRD [6:0] is also inverted.

2. First Detailed Example of Configuration

Figure 3:
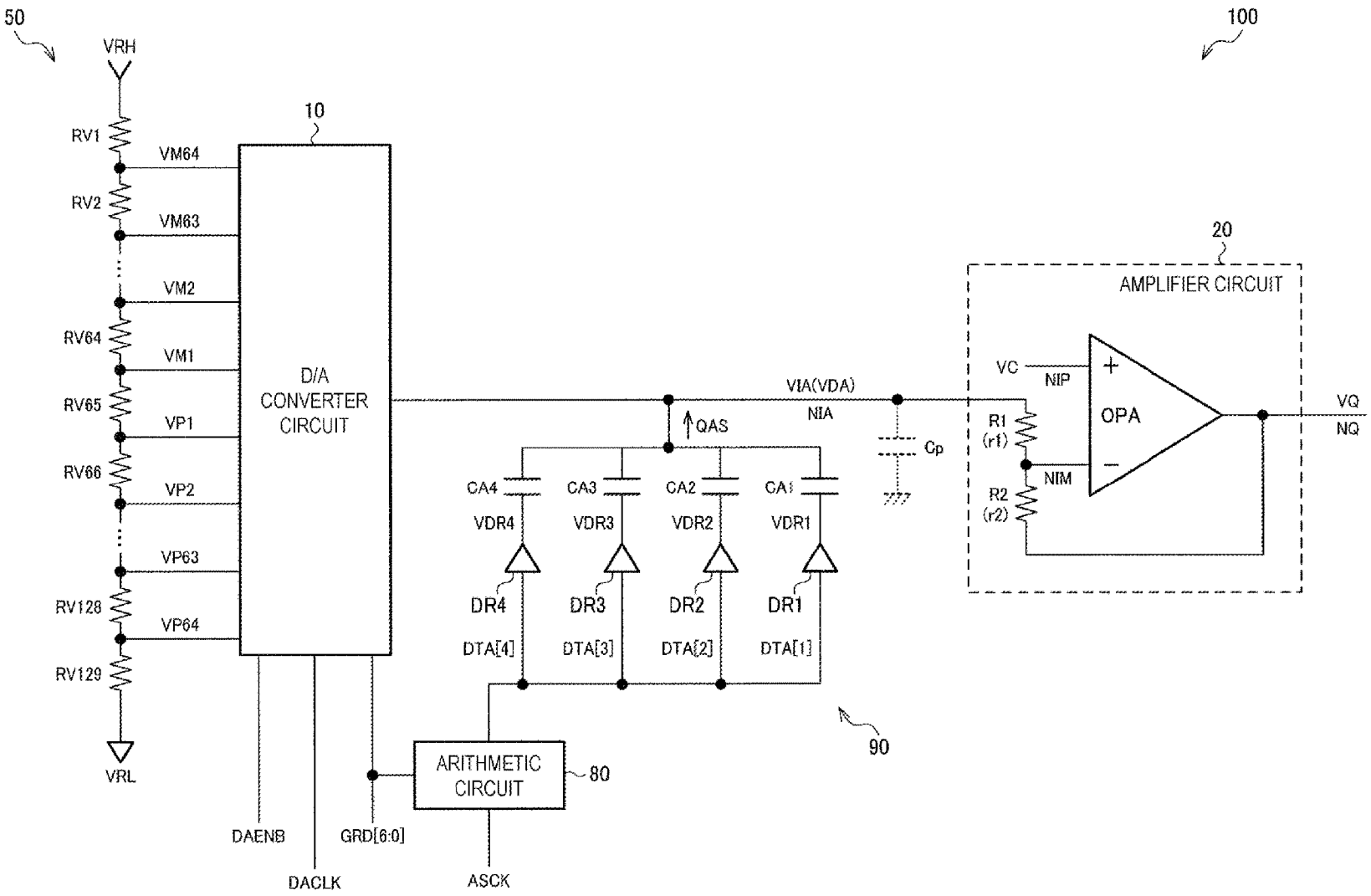
FIG. 3 is a first detailed example of a configuration of the display driver and a supply circuit.

FIG. 3 is a first detailed example of a configuration of the display driver 100 and the supply circuit 90. In FIG. 3, the supply circuit 90 includes capacitors CA1 to CA4 (first to fourth capacitors) and buffers DR1 to DR4 (first to fourth buffers). Note that the same components as the components already described have the same reference numerals, and description of the components will be appropriately omitted. The number of capacitors and buffers of the supply circuit 90 is not limited to FIG. 3, and the supply circuit 90 may include first to n-th capacitors (n is an integer of two or more) and first to n-th buffers. For example, the number of n may be the same number of bits of high-order bit data used by the arithmetic circuit 80 among the display data GRD [6:0].

First ends of the capacitors CA1 to CA4 are coupled to the input node NIA of the amplifier circuit 20. The buffers DR1 to DR4 (driving units, drive circuits) respectively output voltages VDR1 to VDR4 (first to fourth voltages. First to n-th voltages in a broad sense) to second ends of the capacitors CA1 to CA4 by the input data DTA [4:1] based on the display data GRD [6:0]. Then, in the auxiliary period, the buffers DR1 to DR4 respectively output the voltages VDR1 to VDR4, and the auxiliary electrical charge QAS is supplied from the first ends of the capacitors CA1 to CA4 to the input node NIA of the amplifier circuit 20.

Specifically, a bit signal DTA [i] of the input data DTA [4:1] is input to a buffer DRi. The buffer DRi outputs a voltage VDRi at a first voltage level in a case where DTA [i]=0 (first logical level), and outputs the voltage VDRi at a second voltage level in a case where DTA [i]=1 (second logical level). For example, the first voltage level is the low electric potential side-power supply voltage VRL, and the second voltage level is the high electric potential side-power supply voltage VRH. For example, the buffer DRi includes a level shifter that level-shifts a voltage level of the bit signal DTA [i] to an output voltage level of the buffer DRi and a buffer circuit that buffers an output of the level shifter.

The output node of the buffer DRi is coupled to the second end of a capacitor CAi (i is an integer of one or greater and four or less), and the voltage VDRi is input to the second end of the capacitor CAi. The capacitors CA1 to CA4 each have a capacitance value weighted by a power of two. Specifically, a capacitance value of the capacitor CAi is $2^{(i-1)}\times$CA1.

The arithmetic circuit 80 logically inverts high-order bit data GRD [6:3] of high-order four bits of the display data GRD [6:0], and outputs the data as the input data DTA [4:1]. For example, when GRD [6:0]=0000000 (gradation value 0), DTA [4:1]=1111. When GRD [6:0]=1000000 (gradation value 64), DTA [4:1]=0111. When GRD [6:0]=1111111 (gradation value 127), DTA [4:1]=0000.

A case where the gradation voltage changes from VDA=VP1=VC (gradation value 64) to the gradation voltage VDA as a target voltage=VM64 (gradation value 0) is assumed. The arithmetic circuit 80 changes the input data DTA [4:1] from 0111 to 1111 at the timing for starting the auxiliary period TA. Thus, the supply circuit 90 outputs the auxiliary electrical charge QAS=CA4×(VRH−VRL)=8×CA1×(VRH−VRL). The capacity Cp of the input node NIA of the amplifier circuit 20 is charged with the auxiliary electrical charge QAS by redistributing an electrical charge. In other words, the voltage of the input node NIA changes from VIA=VC to VIA=CAS/Cp+VC=(8×CA1/Cp)×(VRH−VRL)+VC. Note that the arithmetic circuit 80 maintains DTA [4:1]=1111 in the non-auxiliary period TB.

Similarly, a case where the gradation voltage changes from VDA=VP1=VC (gradation value 64) to the gradation voltage VDA as a target voltage=VP64 (gradation value 127) is assumed. The arithmetic circuit 80 changes the input data DTA [4:1] from 0111 to 0000 at the timing for starting the auxiliary period TA. Thus, the supply circuit 90 outputs the auxiliary electrical charge QAS=−(CA1+CA2+CA3)×(VRH−VRL)=−7×CA1×(VRH−VRL). The voltage of the input node NIA changes from VIA=VC to VIA=CAS/Cp+VC=−(7×CA1/Cp)×(VRH−VRL)+VC. Note that the arithmetic circuit 80 maintains DTA [4:1]=0000 in the non-auxiliary period TB.

On the assumption that CO=CA1+CA2+CA3+CA4=15×CA1, the maximum change range of the voltage VIA by the auxiliary electrical charge QAS is {(8×CA1/Cp)×(VRH−VRL)+VC}−{−(7×CA1/Cp)×(VRH−VRL)+VC}=CO/Cp×(VRH−VRL). The maximum change range of the gradation voltage VDA is VM64−VP64, and thus a capacitance value of the capacitors CA1 to CA4 is previously set such that CO/Cp×(VRH−VRL)=VM64−VP64, i.e., CO=Cp×(VM64−VP64)/(VRH−VRL). In this way, the voltage VIA changes to the vicinity of a target voltage by the auxiliary electrical charge QAS in the auxiliary period TA. For example, when the target voltage is VM64 (gradation value 0), VIA=(8/15)×(VM64−VP64)+VC by the auxiliary electrical charge QAS. When the target voltage is VP64 (gradation value 127), VIA=−(7/15)×(VM64−VP64)+VC by the auxiliary electrical charge QAS.

According to the exemplary embodiment above, the buffers DR1 to DR4 respectively output the voltages VDR1 to VDR4 to the second ends of the capacitors CA1 to CA4 by the input data DTA [4:1] based on the display data GRD [6:0]. Thus, the auxiliary electrical charge QAS can be supplied from the first ends of the capacitors CA1 to CA4 to the input node NIA of the amplifier circuit 20. Thus, the voltage VIA of the input node NIA can change to (the vicinity of) the target voltage by redistributing an electrical charge between the capacitors CA1 to CA4 and the capacity Cp of the input node NIA in the auxiliary period TA. The voltage change by redistributing the electrical charge can be achieved at a speed higher than a speed at which the D/A converter circuit 10 changes the voltage VIA of the input node NIA. Thus, the voltage VIA of the input node NIA can change at a high speed in the auxiliary period TA.

In one exemplary embodiment, the arithmetic circuit 80 computes the input data DTA [4:1], based on the display data GRD [6:0] and then outputs the input data DTA [4:1] to the buffers DR1 to DR4.

The gradation voltage VDA output from the D/A converter circuit 10 is a voltage obtained by converting the display data GRD [6:0] from digital to analog. According to one exemplary embodiment, the input data DTA [4:1] is computed based on the display data GRD [6:0], and thus the input data DTA [4:1] that achieves a target voltage corresponding to the gradation voltage VDA can be supplied to the buffers DR1 to DR4. Note that the case where data obtaining by logically inverting the high-order bit data GRD [6:3] of the display data is used as the input data DTA [4:1] is described above as an example, but a computing technique of the input data DTA [4:1] is not limited to this. For example, the input data DTA [4:1] may be obtained by multiplying the display data GRD [6:0] by a given gain.

3. Second Detailed Example of Configuration

Figure 4:
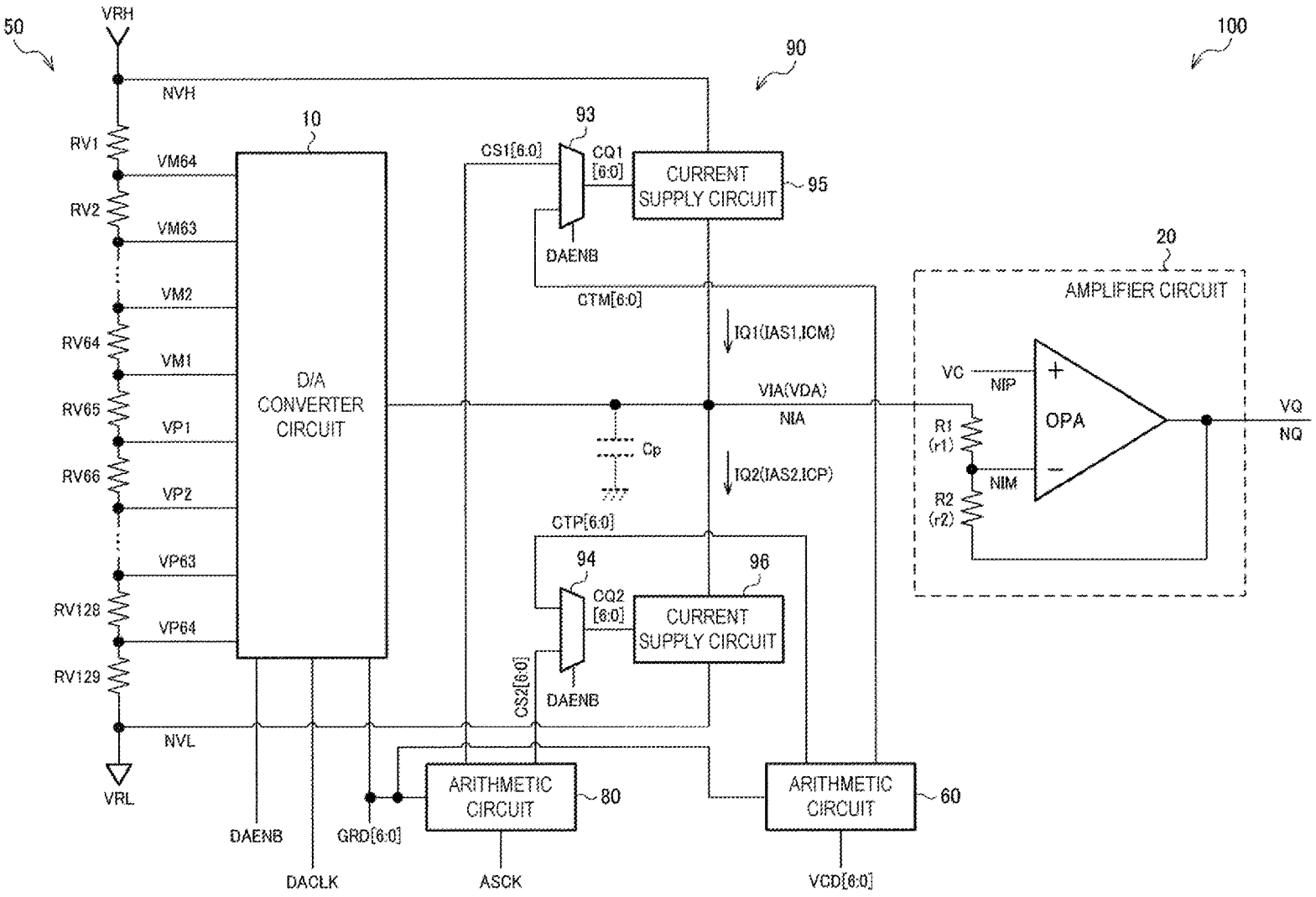
FIG. 4 is a second detailed example of a configuration of the display driver and the supply circuit.

FIG. 4 is a second detailed example of a configuration of the display driver 100 and the supply circuit 90. In FIG. 4, the supply circuit 90 includes a current supply circuit 95 (first current supply circuit) and a current supply circuit (second current supply circuit). The display driver 100 can include an arithmetic circuit 60 (second arithmetic circuit) and selectors 93 and 94. Note that the same components as the components already described have the same reference numerals, and description of the components will be appropriately omitted. The arithmetic circuit 60 and the selectors 93 and 94 may be omitted in FIG. 4. In this case, setting data CS1 [6:0] and CS2 [6:0] from the arithmetic circuit 80 are input to the current supply circuits 95 and 96, respectively.

The current supply circuit 95 is provided between a node NVH of a high electric potential side-power supply voltage and the input node NIA of the amplifier circuit 20, and passes an auxiliary current IAS1 from the node NVH of the high electric potential side-power supply voltage to the input node NIA in the auxiliary period TA. The current supply circuit 96 is provided between a node NVL of a low electric potential side-power supply voltage and the input node NIA of the amplifier circuit 20, and passes an auxiliary current IAS2 from the input node NIA to the node NVL of the low electric potential side-power supply voltage in the auxiliary period TA.

Specifically, the arithmetic circuit 80 computes the setting data CS1 [6:0] for controlling a current value of the auxiliary current IAS1 and the setting data CS2 [6:0] for controlling a current value of the auxiliary current IAS2, based on the display data GRD [6:0]. The arithmetic circuit 80 obtains the setting data CS1 [6:0] and CS2 [6:0], based on differential data between the display data GRD [6:0] this time and the display data GRD [6:0] the last time. For example, data obtained by multiplying an absolute value of the differential data by a given gain (hereinafter referred to as computation data) is obtained as the setting data CS1 [6:0] and CS2 [6:0]. In a case where the differential data has a positive value (the voltage VIA is reduced), the arithmetic circuit 80 outputs the computation data as CS2 [6:0] in the auxiliary period TA, and CS1 [6:0] is disabled ("1111111"). In a case where the differential data has a negative value (the voltage VIA is increased), the arithmetic circuit 80 outputs the computation data as CS1 [6:0] in the auxiliary period TA, and CS2 [6:0] is disabled ("0000000"). Note that CS1 [6:0] and CS2 [6:0] are disabled in a period other than the auxiliary period TA.

The selector 93 selects CS1 [6:0] when the output of the D/A converter circuit 10 is in a high impedance state (DAENB=0), and outputs CS1 [6:0] as setting data CQ1 [6:0] to the current supply circuit 95. An output current of the current supply circuit 95 is assumed to be IQ1. The auxiliary current IAS1 having a current value set by CS1 [6:0] is output as the output current IQ1 in the auxiliary period TA. Similarly, the selector 94 selects CS2 [6:0] when the output of the D/A converter circuit 10 is in a high impedance state, and outputs CS2 [6:0] as setting data CQ2 [6:0] to the current supply circuit 96. An output current of the current supply circuit 96 is assumed to be IQ2. The auxiliary current IAS2 having a current value set by CS2 [6:0] is output as the output current IQ2 in the auxiliary period TA.

Figure 5:
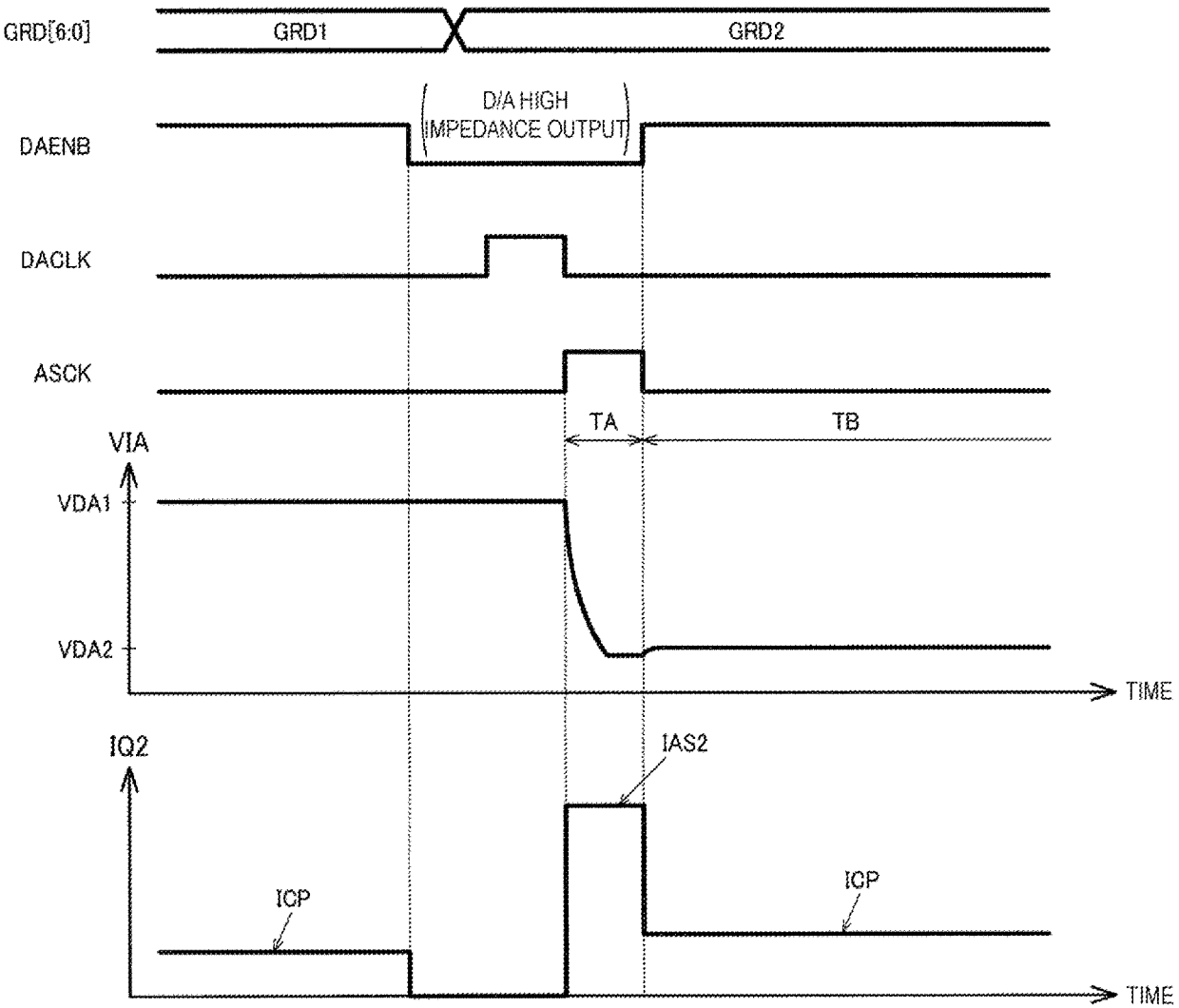
FIG. 5 is a timing chart for describing an operation of the display driver of the second detailed example of the configuration.

FIG. 5 is a timing chart for describing an operation of the display driver 100 of the second detailed example of the configuration. In the example of FIG. 5, a difference between the display data GRD2 this time and the display data GRD1 the last time has a negative value, and the gradation voltage output from the D/A converter circuit 10 is reduced from VDA1 to VDA2. In this case, the current supply circuit 96 passes IQ2=IAS2 from the input node NIA of the amplifier circuit 20 to the node NVL of the low electric potential side-power supply voltage in the auxiliary period TA. On the assumption that a length of the auxiliary period TA is ta, an electrical charge supplied to the input node NIA is −IAS2×ta, and a change in the voltage VIA of the input node NIA is −IAS2×ta/Cp. The arithmetic circuit 80 outputs the setting data CS2 [6:0] such that IAS2×ta/Cp=|VDA2−VDA1|, i.e., IAS2=Cp×|VDA2−VDA1|/ta. |VDA2−VDA1| is proportional to an absolute value |GRD2−GRD1| of the difference in the display data, and thus the arithmetic circuit 80 obtains the setting data CS2 [6:0] from the absolute value |GRD2−GRD1| of the difference in the display data. Note that IQ2=0 in a period in which the output of the D/A converter circuit 10 is in the high impedance state and a period other than the auxiliary period TA.

According to the exemplary embodiment above, in the auxiliary period TA, the current supply circuit 95 passes the auxiliary current IAS1 from the node NVH of the high electric potential side-power supply voltage to the input node NIA, or the current supply circuit 96 passes the auxiliary current IAS2 from the input node NIA to the node NVL of the low electric potential side-power supply voltage. Thus, the capacity Cp of the input node NIA can be charged. Accordingly, the voltage VIA of the input node NIA can change to (the vicinity of) the target voltage in the auxiliary period TA. A voltage change by supplying a current can be achieved at a speed higher than a speed at which the D/A converter circuit 10 changes the voltage VIA of the input node NIA. Thus, the voltage VIA of the input node NIA can change at a high speed in the auxiliary period TA.

In one exemplary embodiment, the current supply circuit 95 passes a compensation current ICM (first compensation current) from the node NVH of the high electric potential side-power supply voltage to the input node NIA of the amplifier circuit 20 in the non-auxiliary period TB. The current supply circuit 96 passes a compensation current ICP (second compensation current) from the input node NIA of the amplifier circuit 20 to the node NVL of the low electric potential side-power supply voltage in the non-auxiliary period TB.

A current flows between the input node NIA and the output node NQ of the amplifier circuit 20 through the resistors R1 and R2. In other words, a current of (VQ−VDA)/(r1+r2) (or (VC−VDA)/r1 or (VQ−VC)/r2) flows from the output node NQ to the input node NIA. The compensation currents ICM and ICP are currents for compensating this current. In other words, the compensation currents ICM and ICP are currents for reducing (or canceling) the current flowing between the input node NIA and the ladder resistance circuit 50 (a node of a voltage selected by the D/A converter circuit 10) through the D/A converter circuit 10.

Specifically, the arithmetic circuit 60 computes setting data CTM [6:0] for controlling a current value of the compensation current ICM and setting data CTP [6:0] for controlling a current value of the compensation current ICP, based on the display data GRD [6:0]. The selector 93 selects CTM [6:0] in the period in which the D/A converter circuit 10 outputs the gradation voltage VDA (non-auxiliary period TB. DAENB=1), and outputs the selected CTM [6:0] as the setting data CQ1 [6:0] to the current supply circuit 95. The current supply circuit 95 outputs the compensation current ICM having a current value set by CTM [6:0] as the output current IQ1. Similarly, the selector 94 selects CTP [6:0] in the period in which the D/A converter circuit 10 outputs the gradation voltage VDA, and outputs the selected CTP [6:0] as the setting data CQ2 [6:0] to the current supply circuit 96. The current supply circuit 96 outputs the compensation current ICP having a current value set by CTP [6:0] as the output current IQ2 in the non-auxiliary period TB.

In FIG. 5, it is assumed that VC>VDA1>VDA2, for example. In this case, the current supply circuit 96 passes the compensation current ICP (IQ2) from the input node NIA of the amplifier circuit 20 to the node NVL of the low electric potential side-power supply voltage in the non-auxiliary period TB. On the other hand, in a case where the gradation voltage output from the D/A converter circuit 10 is VDA>VC, the current supply circuit 95 passes the compensation current ICM (IQ1) from the node NVH of the high electric potential side-power supply voltage to the input node NIA of the amplifier circuit 20 in the non-auxiliary period TB.

In a case where the inverting amplifier circuit including the resistors R1 and R2 provided as feedback circuits between the input node NIA and the output node NQ is adopted as the amplifier circuit 20, a current flows between the input node NIA of the amplifier circuit 20 and the ladder resistance circuit 50 through the D/A converter circuit 10. A voltage value of the gradation voltage VDA is determined by resistor division with the ladder resistance circuit 50, and thus an error occurs in the gradation voltage VDA when a current flows from the inverting amplifier circuit. For example, in a case where the voltage VM64 is selected as the gradation voltage VDA, a current flows from the node between the resistor RV1 and the resistor RV2 to the input node NIA of the amplifier circuit 20. Then, a current flowing through the resistors RV2 to RV129 decreases, and the error occurs in a direction in which the voltage VM64 is lowered. Alternatively, when the voltage VP63 is selected as the gradation voltage VDA, a current flows from the input node NIA of the amplifier circuit 20 to the node between the resistor RV127 and the resistor RV128. Then, a current flowing through the resistors RV128 and RV129 increases, and an error occurs in a direction in which the voltage VP63 rises.

According to one exemplary embodiment, the current supply circuit 95 passes the compensation current ICM from the node NVH of the high electric potential side-power supply voltage to the input node NIA of the amplifier circuit 20, and the current supply circuit 96 passes the compensation current ICP from the input node NIA of the amplifier circuit 20 to the node NVL of the low electric potential side-power supply voltage. Thus, the current flowing between the input node NIA of the amplifier circuit 20 and the ladder resistance circuit 50 through the D/A converter circuit 10 can be compensated. Accordingly, while the amplifier circuit 20 including the resistors R1 and R2 provided as feedback circuits between the input node NIA and the output node NQ is adopted, an error in the gradation voltage VDA output from the D/A converter circuit 10 can be reduced (or canceled).

Figure 6:
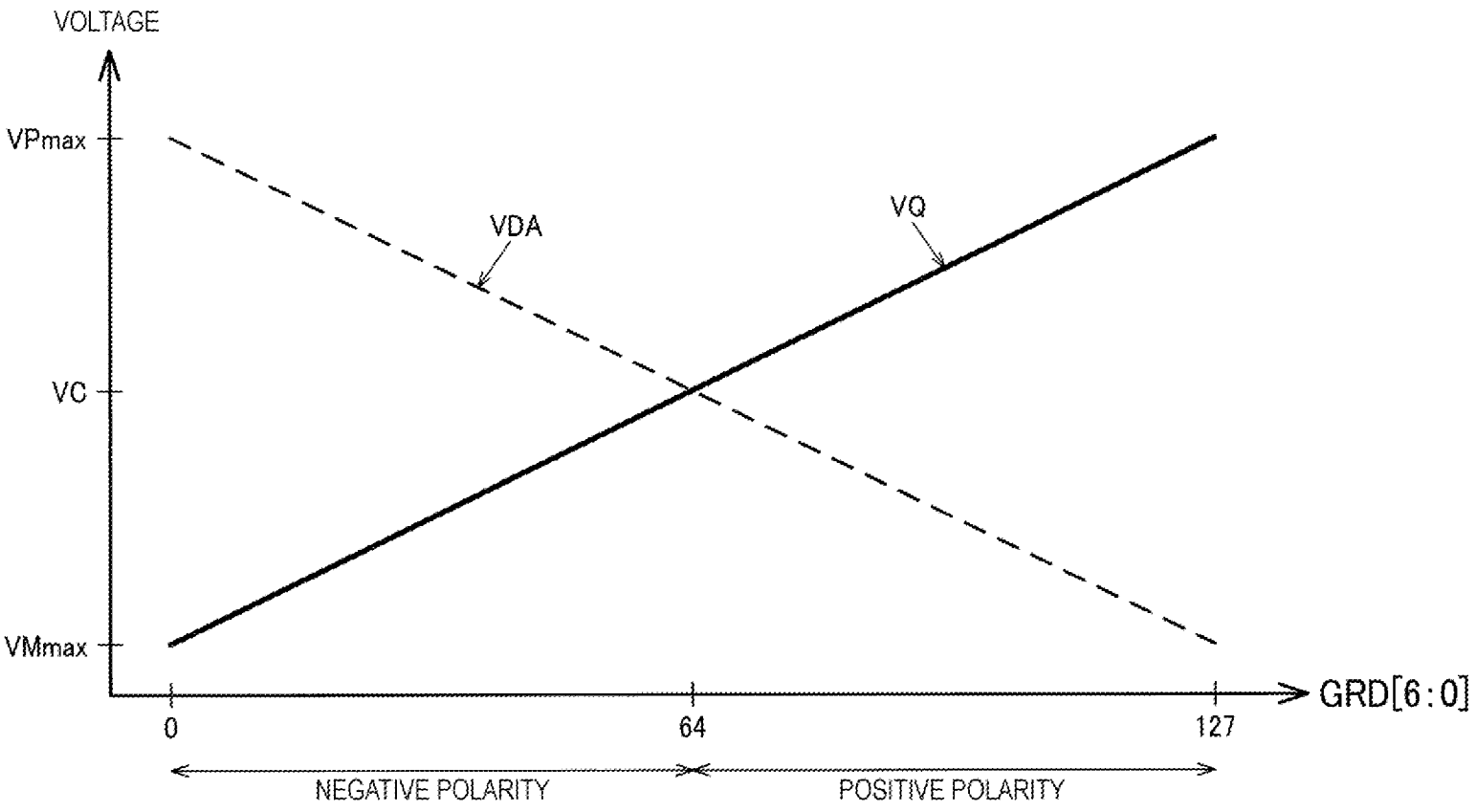
FIG. 6 is a diagram for describing an operation of the display driver of the second detailed example of the configuration.
Figure 7:
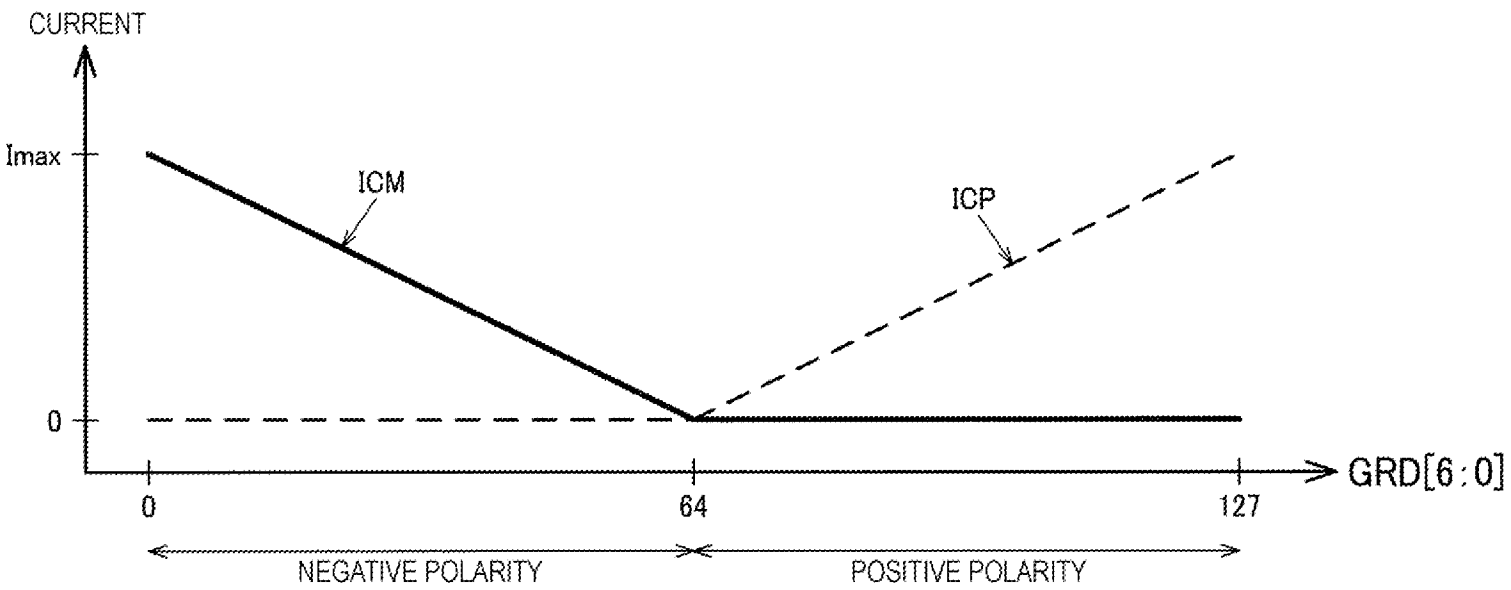
FIG. 7 is a diagram for describing an operation of the display driver of the second detailed example of the configuration.

FIGS. 6 and 7 are diagrams for describing an operation of the display driver 100 of the second detailed example of the configuration. In FIGS. 6 and 7, a gradation value of the display data GRD [6:0] is expressed in decimal. In addition, a case where a gain of the amplifier circuit 20 is −1 (i.e., r1=r2) will be described as an example. Note that the gain of the amplifier circuit 20 is not limited to −1.

As illustrated in FIG. 6, the gradation voltage VDA changes linearly, for example, with respect to a gradation value of GRD [6:0]. When GRD [6:0]=0, VDA=VPmax (VM64). When GRD [6:0]=64, VDA=VC. When GRD [6:0]=127, VDA=VMmax (VP64). For a data voltage after inversion amplification, when GRD [6:0]=0, VQ=VMmax. When GRD [6:0]=64, VQ=VC. When GRD [6:0]=127, VQ=VPmax. Therefore, VQ<VC<VDA in gradation of a negative polarity (gradation values "0" to "63"), and VQ≥VC≥VDA in gradation of a positive polarity (gradation values "64" to "127"). Note that VPmax is a maximum gradation voltage of the positive polarity and VMmax is a maximum gradation voltage of the negative polarity (gradation voltage farthest from VC). In addition, (VPmax+VMmax)/2=VC.

As illustrated in FIG. 7, in the gradation of the negative polarity, the current supply circuit 95 (current compensating circuit) passes the compensation current ICM from the node NVH of the high electric potential side-power supply voltage to the input node NIA of the amplifier circuit 20. VQ<VC<VDA in the gradation of the negative polarity and a current flows from the input node NIA to the output node NQ of the amplifier circuit 20, and thus at least a part of (the whole or a part of) the current is supplied from the current supply circuit 95 (absorbed by the current supply circuit 95). For example, when GRD [6:0]=0, ICM=Imax, and ICM changes (decreases) linearly with respect to a gradation value at GRD [6:0]<64. When GRD [6:0]≥64, ICM=0. Imax is a maximum value of the compensation current. For example, Imax=|(VMmax−VPmax)/(r1+r2)| or Imax=|(VC−VPmax)/r1|.

In the gradation of the positive polarity, the current supply circuit 96 passes the compensation current ICP from the input node NIA of the amplifier circuit 20 to the node NVL of the low electric potential side-power supply voltage. VQ≥VC≥VDA in the gradation of the negative polarity and a current flows from the output node NQ to the input node NIA of the amplifier circuit 20, and thus at least a part of (the whole or a part of) the current is absorbed by the current supply circuit 96. For example, when GRD [6:0]≤64, ICP=0, and ICP changes (increases) linearly with respect to a gradation value at GRD [6:0]≥64. When GRD [6:0]=127, ICP=Imax.

In the exemplary embodiment above, when the output voltage VQ of the amplifier circuit 20 is lower than the reference voltage VC, the current supply circuit 95 passes the compensation current ICM. When the output voltage VQ of the amplifier circuit 20 is higher than the reference voltage VC, the current supply circuit 96 passes the compensation current ICP.

In this way, in the negative-polarity driving (negative period) in which VQ<VC, at least a part of the current flowing from the input node NIA to the output node NQ of the amplifier circuit 20 can be supplied from the current supply circuit 95. Further, in the positive-polarity driving (positive period) in which VQ>VC, at least a part of the current flowing from the output node NQ to the input node NIA of the amplifier circuit 20 can be absorbed by the current supply circuit 96. Thus, the current flowing between the input node NIA of the amplifier circuit 20 and the ladder resistance circuit 50 through the D/A converter circuit 10 can be reduced (compensated).

In the exemplary embodiment, when the output voltage VQ of the amplifier circuit 20 is lower than the reference voltage VC, the current supply circuit 95 passes the compensation current ICM having a current value increased with a greater voltage difference between the output voltage VQ of the amplifier circuit 20 and the reference voltage VC. When the output voltage VQ of the amplifier circuit 20 is higher than the reference voltage VC, the current supply circuit 96 passes the compensation current ICP having a current value increased with a greater voltage difference between the output voltage VQ of the amplifier circuit 20 and the reference voltage VC.

The current flowing between the output node NQ and the input node NIA of the amplifier circuit 20 has magnitude of |(VQ−VC)/r2|, and the magnitude of the current increases with a greater voltage difference between the output voltage VQ of the amplifier circuit 20 and the reference voltage VC. Thus, the current flowing between the output node NQ and the input node NIA of the amplifier circuit 20 can be effectively compensated by passing the compensation currents ICM and ICP having a current value increased with a greater voltage difference between the output voltage VQ of the amplifier circuit 20 and the reference voltage VC.

In one exemplary embodiment, the arithmetic circuit 60 performs arithmetic processing based on the display data GRD [6:0], and outputs the setting data CTM [6:0] (first setting data, first setting signal) for setting a current value of the compensation current ICM and the setting data CTP [6:0] (second setting data, second setting signal) for setting a current value of the compensation current ICP. Then, the current supply circuit 95 outputs the compensation current ICM having a current value set by the setting data CTM [6:0]. The current supply circuit 96 outputs the compensation current ICP having a current value set by the setting data CTP [6:0].

The arithmetic circuit 60 is realized by a logic circuit. Note that the arithmetic circuit 60 may be realized by a DSP that executes a plurality of processes of digital signal processing in a time-division manner. In this case, the arithmetic processing is executed in the time-division manner together with other digital signal processing (for example, arithmetic processing performed by the arithmetic circuit 80).

According to one exemplary embodiment, the arithmetic circuit 60 obtains the setting data CTM [6:0] and CTP [6:0], based on the display data GRD [6:0], and thus the compensation currents ICM and ICP having a current value corresponding to a gradation value of the display data GRD [6:0] (i.e., the output voltage VQ of the amplifier circuit 20) can be output.

In one exemplary embodiment, the arithmetic circuit 60 outputs the setting data CTM [6:0] for increasing a current value of the compensation current ICM with a greater difference between a gradation value of the display data GRD [6:0] and a gradation value corresponding to the reference voltage VC in the positive period of the polarity inversion driving. The arithmetic circuit 60 outputs the setting data CTP [6:0] for increasing a current value of the compensation current ICP with a greater difference between a gradation value of the display data GRD [6:0] and a gradation value corresponding to the reference voltage VC in the negative period of the polarity inversion driving.

Specifically, data of a gradation value corresponding to the reference voltage VC is assumed to be reference data VCD [6:0]. The reference data VCD [6:0] is the same data as the display data GRD [6:0] for making an output voltage of the amplifier circuit 20 to be VQ=VC (making an output voltage of the D/A converter circuit 10 to be VDA=VC). For example, VCD [6:0]=0100000 (gradation value "64"). The arithmetic circuit 60 outputs the setting data CTM [6:0] and CTP [6:0], based on a difference between the display data GRD [6:0] and the reference data VCD [6:0]. For example, it is assumed that a current value of the compensation currents ICM and ICP is increased with a greater value of the setting data CTM [6:0] and CTP [6:0]. In this case, a value of the setting data CTM [6:0] and CTP [6:0] is increased with a greater difference (greater magnitude of a difference) between the display data GRD [6:0] and the reference data VCD [6:0]. Note that the reference data VCD [6:0] may be, for example, set by register writing and the like from the outside of the display driver 100, input from a control circuit (for example, a control circuit 180 in FIG. 15) of the display driver 100 to the arithmetic circuit 60, or incorporated as a fix value into the arithmetic circuit 60.

According to one exemplary embodiment, the setting data CTM [6:0] and CTP [6:0] for increasing a current value of the compensation currents ICM and ICP with a greater difference between a gradation value of the display data GRD [6:0] and a gradation value corresponding to the reference voltage VC are output. Thus, the compensation currents ICM and ICP having a current value increased with a greater voltage difference between the output voltage VQ of the amplifier circuit 20 and the reference voltage VC can flow.

Note that the case where the display data GRD [6:0] can indicate both gradation in the positive-polarity driving and gradation in the negative-polarity driving is described above as an example. However, the configuration of the display data GRD [6:0] is not limited to this. For example, display data may indicate mere gradation that does not include information about polarity, and a polarity signal for controlling driving polarity may be provided separately. In this case, the D/A converter circuit 10 may select a gradation voltage from a plurality of voltages, based on the display data and the polarity signal. A gradation value corresponding to the reference voltage VC is, for example, zero, and thus the arithmetic circuit 60 may generate setting data for a compensation current from the display data instead of a difference between the display data and the reference data. At this time, which of the compensation currents ICM and ICP is output may be controlled based on the polarity signal.

4. Current Supply Circuit in Second Detailed Example of Configuration

Figure 8:
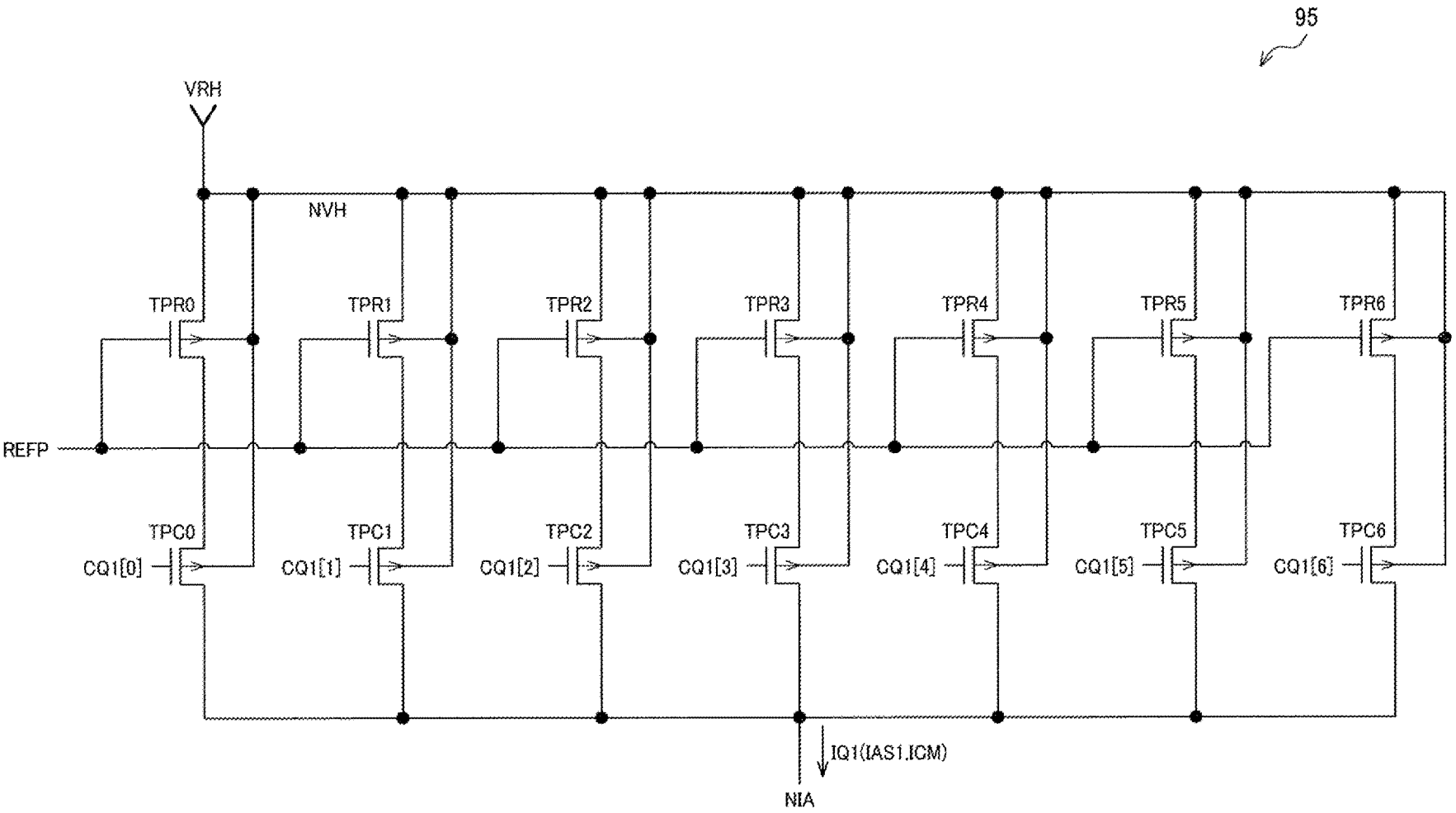
FIG. 8 is a detailed example of a configuration of a current supply circuit.

FIG. 8 is a detailed example of a configuration of the current supply circuit 95. The current supply circuit 95 includes P-type transistors TPR0 to TPR6 and P-type transistors TPC0 to TPC6.

The P-type transistor TPR0 and the P-type transistor TPC0 are coupled to each other in series between the node NVH of the high electric potential side-power supply voltage and the input node NIA of the amplifier circuit 20. A bit signal CQ1 [0] of the setting data CQ1 [6:0] is input to a gate of the P-type transistor TPC0. Similarly, the P-type transistors TPR1 to TPR6 and the P-type transistors TPC1 to TPC6 are respectively coupled to each other in series between the node NVH of the high electric potential side-power supply voltage and the input node NIA of the amplifier circuit 20. Bit signals CQ1 [1] to CQ1 [6] are respectively input to gates of the P-type transistors TPC1 to TPC6. A bias voltage REFP for setting a drain current of the P-type transistors TPR0 to TPR6 is input to gates of the P-type transistors TPR0 to TPR6. The drain current of the P-type transistors TPR0 to TPR6 is set such that its ratio is a power of two (binary). In other words, a size of a P-type transistor TPRk (k is an integer of one or greater and six or less) is $2^k$ times a size of the P-type transistor TPR0, and a size of a P-type transistor TPCk is $2^k$ times a size of the P-type transistor TPC0. Note that the transistor size may be set by, for example, W/L (W is a channel width and L is a channel length) of a transistor or the number (i.e., a total size) of unit transistors.

When CQ1 [6:0] (CS1 [6:0] or CTM [6:0])=1111111, all of the P-type transistors TPC0 to TPC6 are off, and the output current IQ1 has a current value of zero. When CQ1 [6:0]≠1111111, turning on and off of the P-type transistors TPC0 to TPC6 is controlled in response to CQ1 [6:0]. Thus, the output current IQ1 is a current value proportional (inversely proportional) to a value of CQ1 [6:0].

Figure 9:
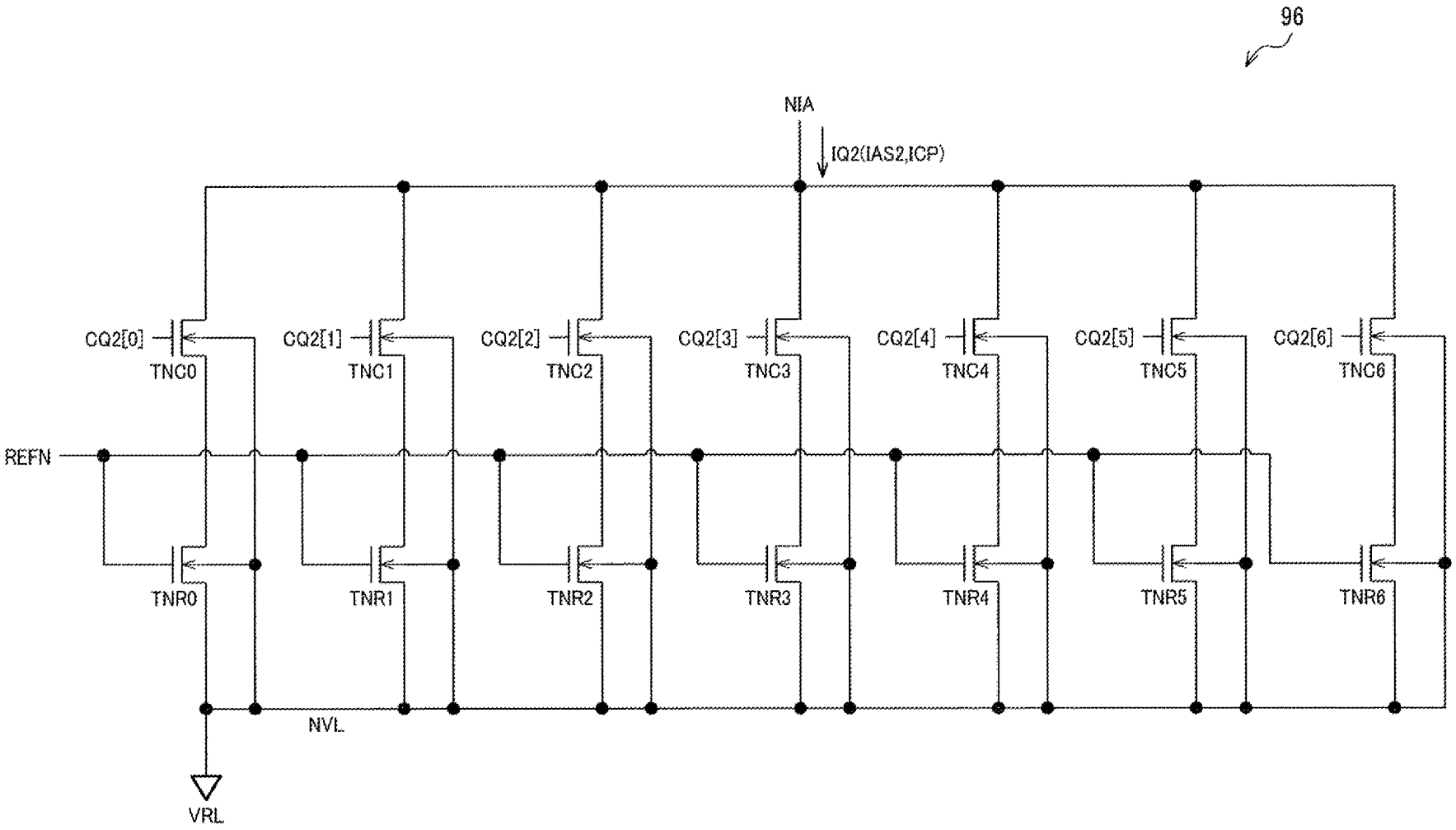
FIG. 9 is a detailed example of a configuration of another current supply circuit.

FIG. 9 is a detailed example of a configuration of the current supply circuit 96. The current supply circuit 96 includes N-type transistors TNR0 to TNR6 and N-type transistors TNC0 to TNC6.

The N-type transistor TNR0 and the N-type transistor TNC0 are coupled to each other in series between the node NVL of the low electric potential side-power supply voltage and the input node NIA of the amplifier circuit 20. A bit signal CQ2 [0] of the setting data CQ2 [6:0] is input to a gate of the N-type transistor TNC0. Similarly, the N-type transistors TNR1 to TNR6 and the N-type transistors TNC1 to TNC6 are respectively coupled to each other in series between the node NVL of the low electric potential side-power supply voltage and the input node NIA of the amplifier circuit 20. Bit signals CQ2 [1] to CQ2 [6] are respectively input to gates of the N-type transistors TNC1 to TNC6. A bias voltage REFN for setting a drain current of the N-type transistors TNR0 to TNR6 is input to gates of the N-type transistors TNR0 to TNR6. The drain current of the N-type transistors TNR0 to TNR6 is set such that its ratio is a power of two (binary). In other words, a size of an N-type transistor TNRk is $2^k$ times a size of the N-type transistor TNR0, and a size of an N-type transistor TNCk is $2^k$ times a size of the N-type transistor TNC0. Note that the transistor size may be set by, for example, W/L (W is a channel width and L is a channel length) of a transistor or the number (i.e., a total size) of unit transistors.

When CQ2 [6:0] (CS2 [6:0] or CTP [6:0])=0000000, all of the N-type transistors TNC0 to TNC6 are off, and the output current IQ2 has a current value of zero. When CQ2 [6:0]≠0000000, turning on and off of the N-type transistors TNC0 to TNC6 is controlled in response to CQ2 [6:0]. Thus, the output current IQ2 is a current value proportional to a value of CQ2 [6:0].

5. Third Detailed Example of Configuration

Figure 10:
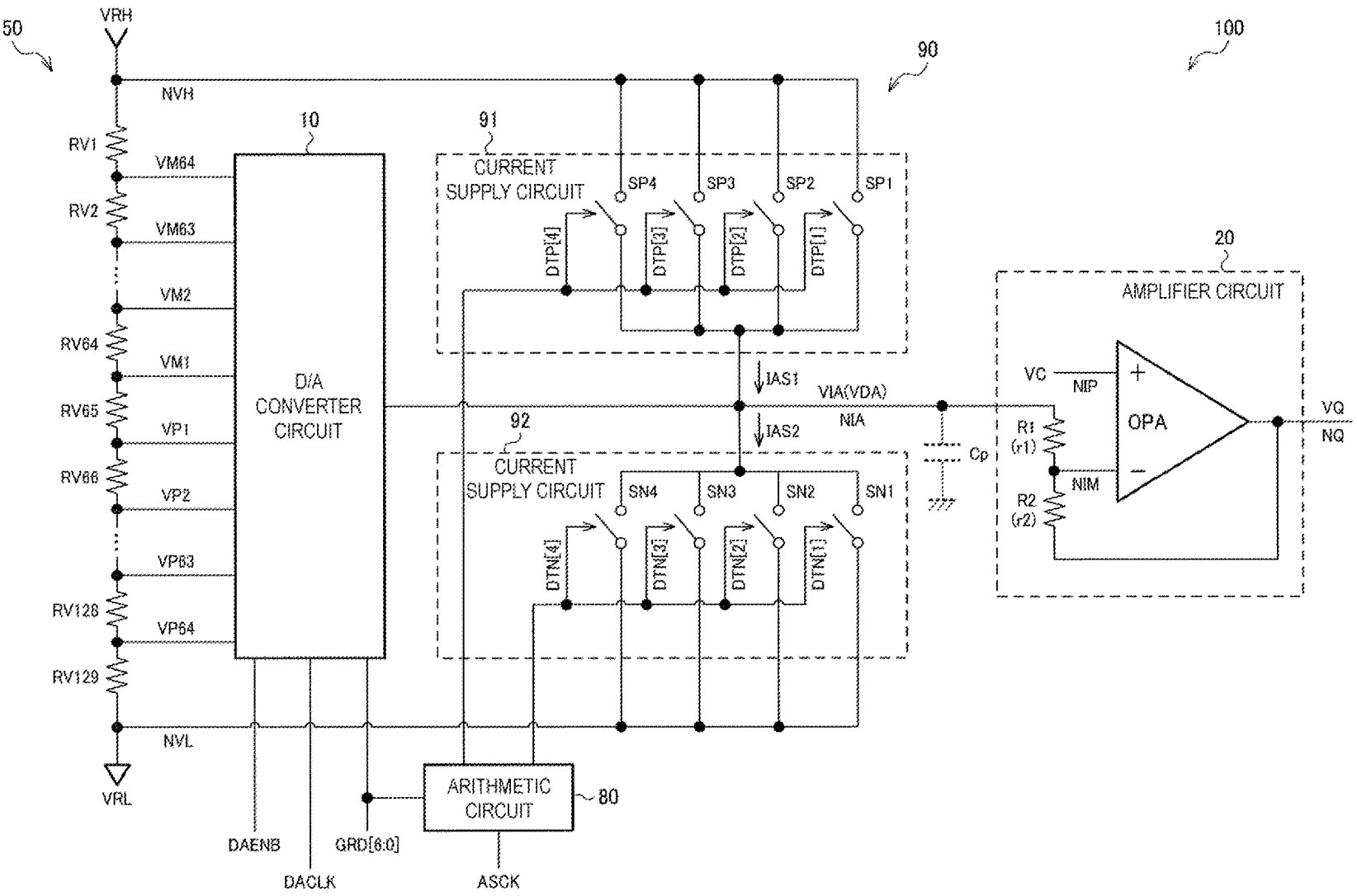
FIG. 10 is a third detailed example of a configuration of the display driver and the supply circuit.

FIG. 10 is a third detailed example of a configuration of the display driver 100 and the supply circuit 90. In FIG. 10, the supply circuit 90 includes a current supply circuit (first current supply circuit) and a current supply circuit 92 (second current supply circuit). Note that the same components as the components already described have the same reference numerals, and description of the components will be appropriately omitted.

The current supply circuit 91 includes switches SP1 to SP4 (first to fourth switches. First to m-th switches (m is an integer of two or greater) in a broad sense) provided between the node NVH of the high electric potential side-power supply voltage and the input node NIA of the amplifier circuit 20. An ability to pass a current of the switches SP1 to SP4 is weighted by a power of two. Turning on and off of the switches SP1 to SP4 are controlled by bit signals DTP [1] to DTP [4] of setting data DTP [4:1], respectively. For example, the switches SP1 to SP4 are P-type transistors, and a size of SPj (j is an integer of one or greater and 4 or less) is $2^{(j-1)}$ times a size of SP1. In this case, when DTP [4:1]=1111, all of the switches SP1 to SP4 are off, and when DTP [4:1]≠1111, at least one of the switches SP1 to SP4 is on and the auxiliary current IAS1 is output.

The current supply circuit 92 includes switches SN1 to SN4 (fifth to eighth switches. (m+1)-th to 2m-th switches in a broad sense) provided between the input node NIA of the amplifier circuit 20 and the node NVL of the low electric potential side-power supply voltage. An ability to pass a current of the switches SN1 to SN4 is weighted by a power of two. Turning on and off of the switches SN1 to SN4 are controlled by bit signals DTN [1] to DTN [4] of setting data DTN [4:1], respectively. For example, the switches SN1 to SN4 are N-type transistors, and a size of SNj is $2^{(j-1)}$ times a size of SN1. In this case, when DTN [4:1]=0000, all of the switches SN1 to SN4 are off, and when DTN [4:1]≠0000, at least one of the switches SN1 to SN4 is on and the auxiliary current IAS2 is output.

Note that the transistor size may be set by, for example, W/L (W is a channel width and L is a channel length) of a transistor or the number (i.e., a total size) of unit transistors.

The arithmetic circuit 80 outputs the setting data DTP [4:1] and DTN [4:1] for outputting the auxiliary currents IAS1 and IAS2 in the auxiliary period TA, based on a signal ASCK. Specifically, when the differential data between the display data GRD [6:0] this time and the display data GRD [6:0] last time has a negative value (the gradation voltage VDA increases), the arithmetic circuit 80 causes the current supply circuit 91 to output the auxiliary current IAS1. On the other hand, when the differential data between the display data GRD [6:0] this time and the display data GRD [6:0] last time has a positive value (the gradation voltage VDA decreases), the arithmetic circuit 80 causes the current supply circuit 92 to output the auxiliary current IAS2.

For example, the gradation voltage decreases from VDA1 to VDA2 (GRD2−GRD1>0) in FIG. 2, and thus the current supply circuit 92 outputs the auxiliary current IAS2. An electrical charge obtained by integrating the auxiliary current IAS2 in the auxiliary period TA is assumes to be Qtot. The electrical charge Qtot is supplied to the capacity Cp of the input node NIA of the amplifier circuit 20 in the auxiliary period TA, and thus the voltage VIA of the input node NIA decreases only by Qtot/Cp. In other words, the arithmetic circuit 80 outputs the setting data DTN [4:1] that satisfies Qtot/Cp=|VDA2−VDA1| to the current supply circuit 92. Specifically, the arithmetic circuit 80 computes the setting data DTN [4:1] from the differential data between the display data GRD [6:0] this time and the display data GRD [6:0] the last time. Similarly, when the gradation voltage increases (GRD2−GRD1<0), the arithmetic circuit 80 computes the setting data DTP [4:1] from the differential data between the display data GRD [6:0] this time and the display data GRD [6:0] the last time. Note that it is sufficient to reach the vicinity of the target voltage (VDA2) in the auxiliary period TA, and thus it does not have to be exactly Qtot/Cp=|VDA2−VDA1|.

For example, the arithmetic circuit 80 obtains the setting data DTP [4:1] and DTN [4:1] by multiplying the differential data between the display data GRD [6:0] this time and the display data GRD [6:0] the last time by a given coefficient. A value proportional to the display data GRD [6:0] this time or the display data GRD [6:0] last time may be further added to the setting data DTP [4:1] and DTN [4:1]. The setting data DTP [4:1] and DTN [4:1] may also be obtained by a polynomial of the differential data. For example, an arithmetic expression may be set according to a characteristic of the ability to drive a current of the switches SP1 to SP4 (P-type transistors) and the switches SN1 to SN4 (N-type transistors).

Note that the switches SP1 to SP4 and the switches SN1 to SN4 are off and the auxiliary currents IAS1 and IAS2 are zero in a period other than the auxiliary period TA.

Even when the supply circuit 90 is configured as described above, the current supply circuit 91 can pass the auxiliary current IAS1 from the node NVH of the high electric potential side-power supply voltage to the input node NIA in the auxiliary period TA, and the current supply circuit 92 can pass the auxiliary current IAS2 from the input node NIA to the node NVL of the low electric potential side-power supply voltage in the auxiliary period TA. A voltage change by supplying a current through a switch can be achieved at a speed higher than a speed at which the D/A converter circuit 10 changes the voltage VIA of the input node NIA. Thus, the voltage VIA of the input node NIA can change to a target voltage at a high speed in the auxiliary period TA.

6. Modified Example

Figure 11:
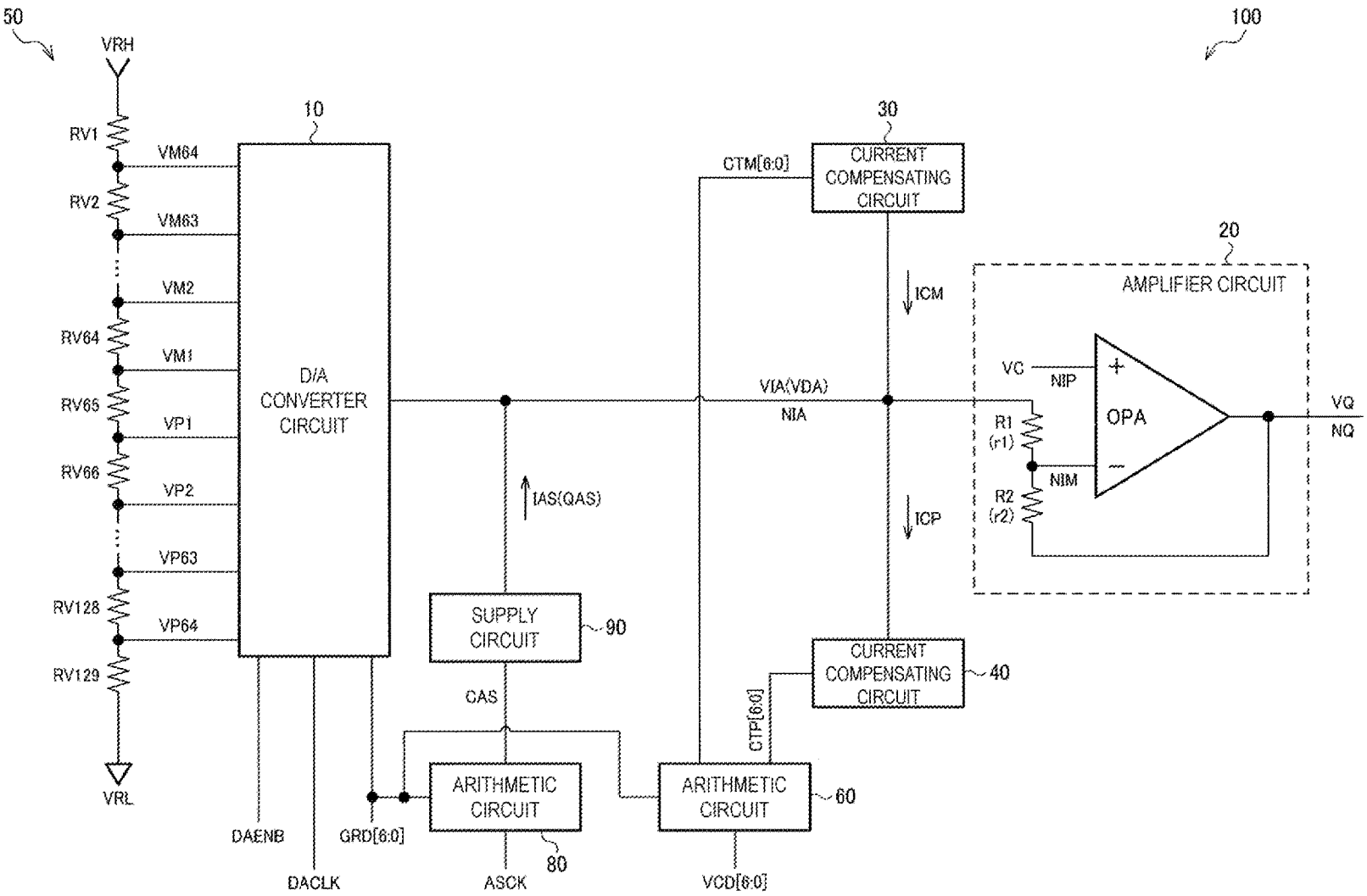
FIG. 11 is a modified example of a configuration of the display driver.

FIG. 11 is a modified example of a configuration of the display driver 100. In FIG. 11, the display driver 100 includes a current compensating circuit 30 (first current compensating circuit), a current compensating circuit 40 (second current compensating circuit), and the arithmetic circuit 60. Note that the same components as the components already described have the same reference numerals, and description of the components will be appropriately omitted.

In a case where the supply circuit 90 in FIG. 3 or the supply circuit 90 in FIG. 10 is adopted, the current compensating circuits 30 and 40 may be further provided to respectively output the compensation currents ICM and ICP in the non-auxiliary period TB. The current compensating circuit 30 has the same configuration as the configuration of the current supply circuit 95 in FIGS. 4 and 8 and receives an input of the setting data CTM [6:0] (does not receive an input of the setting data CS1 [6:0]). The current compensating circuit 40 has the same configuration as the configuration of the current supply circuit 96 in FIGS. 4 and 8 and receives an input of the setting data CTP [6:0] (does not receive an input of the setting data CS2 [6:0]). In other words, the supply circuit 90 outputs the auxiliary current IAS or the auxiliary electrical charge QAS to the input node NIA of the amplifier circuit 20 in the auxiliary period TA, and the current compensating circuits 30 and 40 respectively output the compensation currents ICM and ICP to the input node NIA of the amplifier circuit 20 in the non-auxiliary period TB.

7. D/A Converter Circuit

Figure 12:
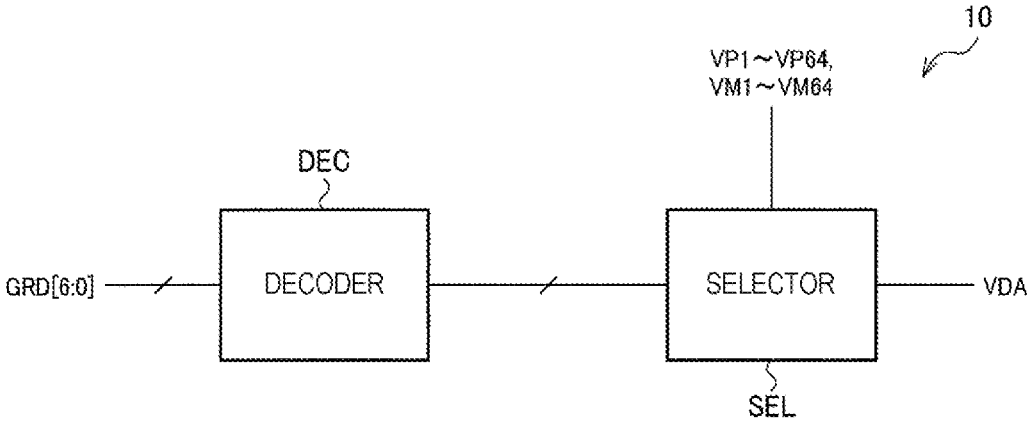
FIG. 12 is a detailed example of a configuration of a D/A converter circuit.

FIG. 12 is a detailed example of a configuration of the D/A converter circuit 10. The D/A converter circuit 10 includes a decoder DEC and a selector SEL.

The decoder DEC decodes the display data GRD [6:0] and outputs a selection signal to the selector SEL. The selector SEL selects a voltage corresponding to the display data GRD [6:0] as the gradation voltage VDA from the plurality of voltages VP1 to VP64 and VM1 to VM64, based on the selection signal from the decoder DEC.

Figure 13:
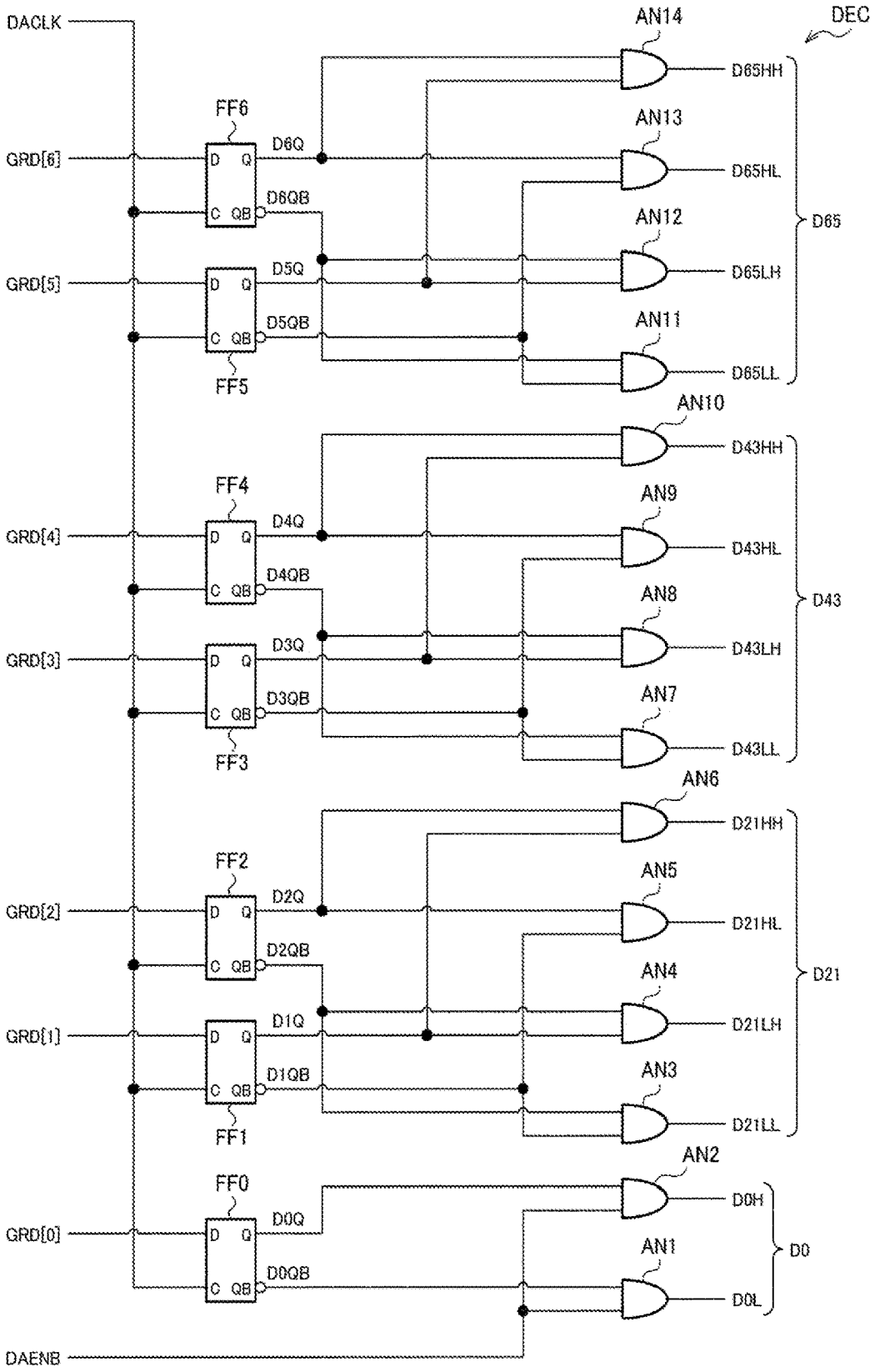
FIG. 13 is a detailed example of a configuration of a decoder.

FIG. 13 is a detailed example of a configuration of the decoder DEC. The decoder DEC includes flip-flop circuits FF0 to FF6 (latching circuits) and AND circuits AN1 to AN14.

The flip-flop circuit FF0 latches GRD [0] at an edge (for example, a rising edge) of a clock signal DACLK and then outputs a latched signal D0Q. The flip-flop circuit FF0 also outputs a signal D0QB generated by logically inverting the signal D0Q. Similarly, the flip-flop circuits FF1 to FF6 respectively latch GRD [1] to GRD [6] at the edge of the clock signal DACLK and then output latched signals D1Q to D6Q. The flip-flop circuits FF1 to FF6 also respectively output signals D1QB to D6QB generated by logically inverting the signals D1Q to D6Q. The clock signal DACLK is input from, for example, a control circuit (control circuit 180 in FIG. 15) of the display driver 100.

The AND circuit AN1 outputs an AND of the signal D0QB and an enable signal DAENB as a signal D0L. The AND circuit AN2 outputs an AND of the signal D0Q and the enable signal DAENB as a signal D0H. In DAENB=1, when GRD [0]=0 and 1, each of the signals D0L and D0H are 1. Only one of the signals D0L and D0H is 1 and the other is 0. In DAENB=0, the signals D0L and D0H are both 0. Hereinafter, the signals D0L and D0H are referred to as a signal group DO. The enable signal DAENB is input from, for example, a control circuit (control circuit 180 in FIG. 15) of the display driver 100.

The AND circuit AN3 outputs an AND of the signal D2QB and the signal D1QB as a signal D21LL. Similarly, the AND circuits AN4, AN5, and AN6 respectively output an AND of the signal D2QB and the signal D1Q, an AND of the signal D2Q and the signal D1QB, and an AND of the signal D2Q and the signal D1Q as signals D21LH, D21HL, and D21HH. When (GRD [2], GRD [1])=(0, 0), (0, 1), (1, 0), and (1, 1), each of the signals D21LL, D21LH, D21HL, and D21HH are 1. Only one of the signals D21LL, D21LH, D21HL, and D21HH is 1, and other three are 0. Hereinafter, the signals D21LL, D21LH, D21HL, and D21HH are referred to as a signal group D21.

The AND circuit AN7 outputs an AND of the signal D4QB and the signal D3QB as a signal D43LL. Similarly, the AND circuits AN8, AN9, and AN10 respectively output an AND of the signal D4QB and the signal D3Q, an AND of the signal D4Q and the signal D3QB, and an AND of the signal D4Q and the signal D3Q as signals D43LH, D43HL, and D43HH. When (GRD [4], GRD [3])=(0, 0), (0, 1), (1, 0), and (1, 1), each of the signals D43LL, D43LH, D43HL, and D43HH are 1. Only one of the signals D43LL, D43LH, D43HL, and D43HH is 1, and other three are 0. Hereinafter, the signals D43LL, D43LH, D43HL, and D43HH are referred to as a signal group D43.

The AND circuit AN11 outputs an AND of the signal D6QB and the signal D5QB as a signal D65LL. Similarly, the AND circuits AN12, AN13, and AN14 respectively output an AND of the signal D6QB and the signal D5Q, an AND of the signal D6Q and the signal D5QB, and an AND of the signal D6Q and the signal D5Q as signals D65LH, D65HL, and D65HH. When (GRD [6], GRD [5])=(0, 0), (0, 1), (1, 0), and (1, 1), each of the signals D65LL, D65LH, D65HL, and D65HH are 1. Only one of the signals D65LL, D65LH, D65HL, and D65HH is 1, and other three are 0. Hereinafter, the signals D65LL, D65LH, D65HL, and D65HH are referred to as a signal group D65.

Note that the decoder DEC includes a level shifter that level-shifts a signal level of the signal groups DO, D21, D43, and D65, which is not illustrated in FIG. 13. The level shifter is a circuit for performing a level shift between a power supply voltage of a logic circuit and a power supply voltage of the selector SEL (VRH and VRL).

Figure 14:
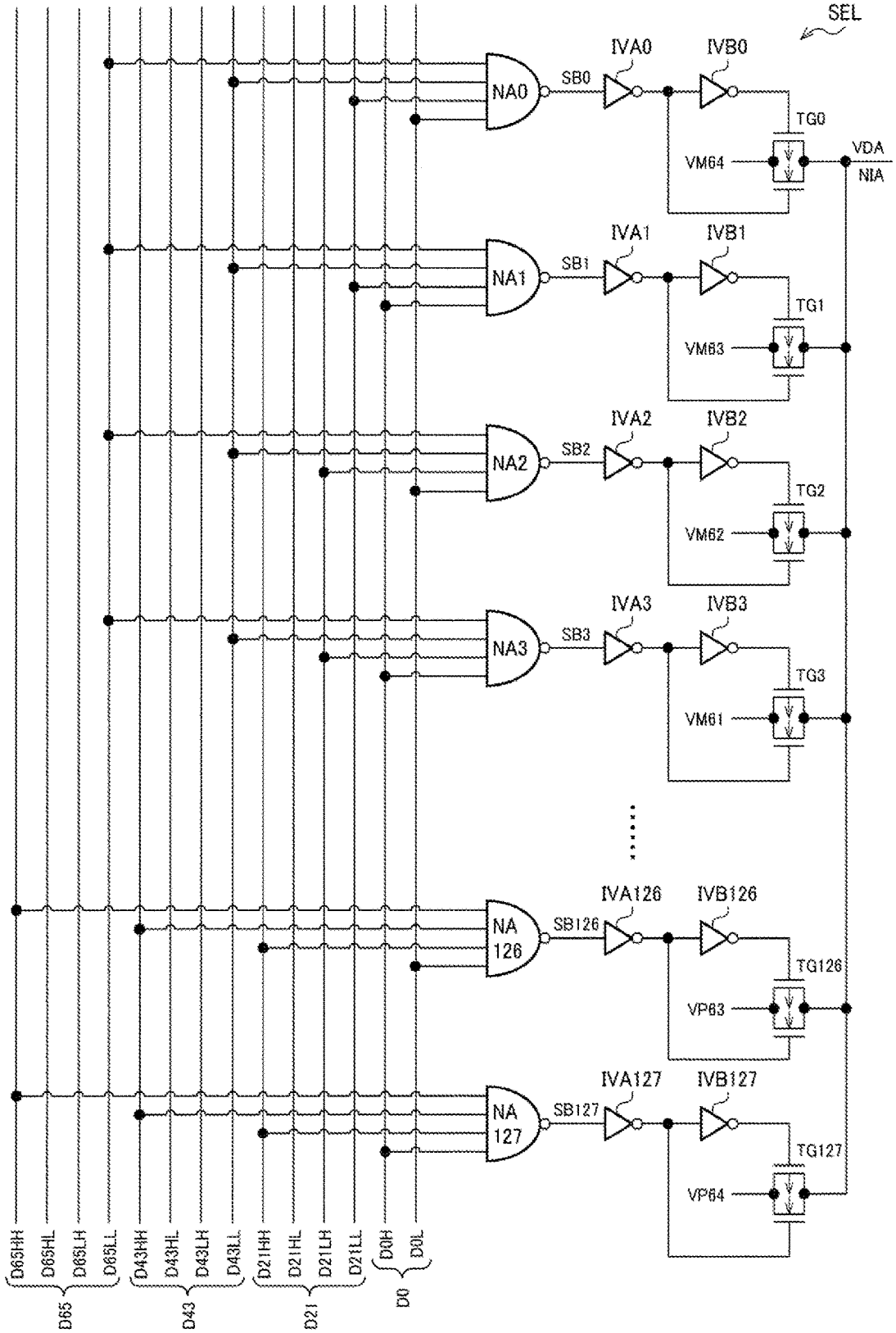
FIG. 14 is a detailed example of a configuration of a selector.

FIG. 14 is a detailed example of a configuration of the selector SEL. The selector SEL includes NAND circuits NA0 to NA127, inverters IVA0 to IVA127, inverters IVB0 to IVB127, and transfer gates TG0 to TG127 (switches).

The NAND circuit NA0 outputs a NAND of the signal D0L of the signal group DO, the signal D21LL of the signal group D21, the signal D43LL of the signal group D43, and the signal D65LL of the signal group D65 as a signal SB0. When GRD [6:0]=0000000 (gradation value "0"), SB0=0. Similarly, the NAND circuits NA1 to NA127 respectively output NANDs of any signal of the signal group DO, any signal of the signal group D21, any signal of the signal group D43, and any signal of the signal group D65 as signals SB1 to SB127. When GRD [6:0]=0000001 (gradation value "1"), 0000010 (gradation value "2"), . . . , 1111111 (gradation value "127"), each of SB1, SB2, . . . , SB127 are 0. Only one of SB0 to SB127 is 0 according to a gradation value of GRD [6:0], and other 127 are 1. Note that when the enable signal DAENB=0, it is satisfied D0L=D0H=0, and thus all of SB0 to SB127 are 1.

Turning on and off of the transfer gate TG0 is controlled by the signal SB0 through the inverters IVA0 and IVB0. The transfer gate TG0 is on when SB0=0 and is off when SB0=1. Thus, when SB0=0 (gradation value "0"), the voltage VM64 is output as the gradation voltage VDA. Similarly, turning on and off of the transfer gates TG1 to TG127 are controlled by the signals SB1 to SB127 through the inverters IVA1 to IVA127 and IVB1 to IVB127, respectively. The transfer gates TG1 to TG127 are on when SB1 to SB127 are 0 and are off when SB1 to SB127 are 1, respectively. Thus, when SB1, SB2, SB63 are 0 (gradation values "1", "2", . . . , "63"), the respective voltages VM63, VM62, VM1 are output as the gradation voltage VDA. When SB64, SB65, SB127 are 0 (gradation values "64", "65", . . . , "127"), the respective voltages VP1, VP2, VP64 are output as the gradation voltage VDA.

According to the exemplary embodiment above, the D/A converter circuit 10 includes a switch group that selects any of the plurality of voltages VP1 to VP64 and VM1 to VM64 as the gradation voltage VDA and a control circuit that controls the switch group, based on the display data GRD [6:0]. The control circuit turns off switches of the switch group in the auxiliary period TA to set the output of the D/A converter circuit 10 in the high impedance state.

Note that the switch group corresponds to the transfer gates TG1 to TG127 of the selector SEL. The control circuit corresponds to the decoder DEC, the NAND circuits NA0 to NA127, the inverters IVA0 to IVA127, and the inverters IVB0 to IVB127 of the selector SEL. Since DAENB=0 in the auxiliary period TA, the signals SB0 to SB127 respectively output from the NAND circuits NA0 to NA127 are all 1, and the switches (transfer gates TG1 to TG127) of the switch group all are off.

The supply circuit 90 supplies the auxiliary current IAS or the auxiliary electrical charge QAS to the input node NIA of the amplifier circuit 20 in the auxiliary period TA. When the auxiliary current IAS or the auxiliary electrical charge QAS flows to the ladder resistance circuit 50, a voltage generated by the ladder resistance circuit 50 may fluctuate, and an error may thus occur in gradation voltage at the end of the auxiliary period TA. According to one exemplary embodiment, the control circuit turns off the switches of the switch group in the auxiliary period TA, and thus the output of the D/A converter circuit 10 can be set in the high impedance state. This can prevent the auxiliary current IAS or the auxiliary electrical charge QAS from flowing to the ladder resistance circuit 50 through the D/A converter circuit 10 in the auxiliary period TA.

8. Electro-Optical Device

Figure 15:
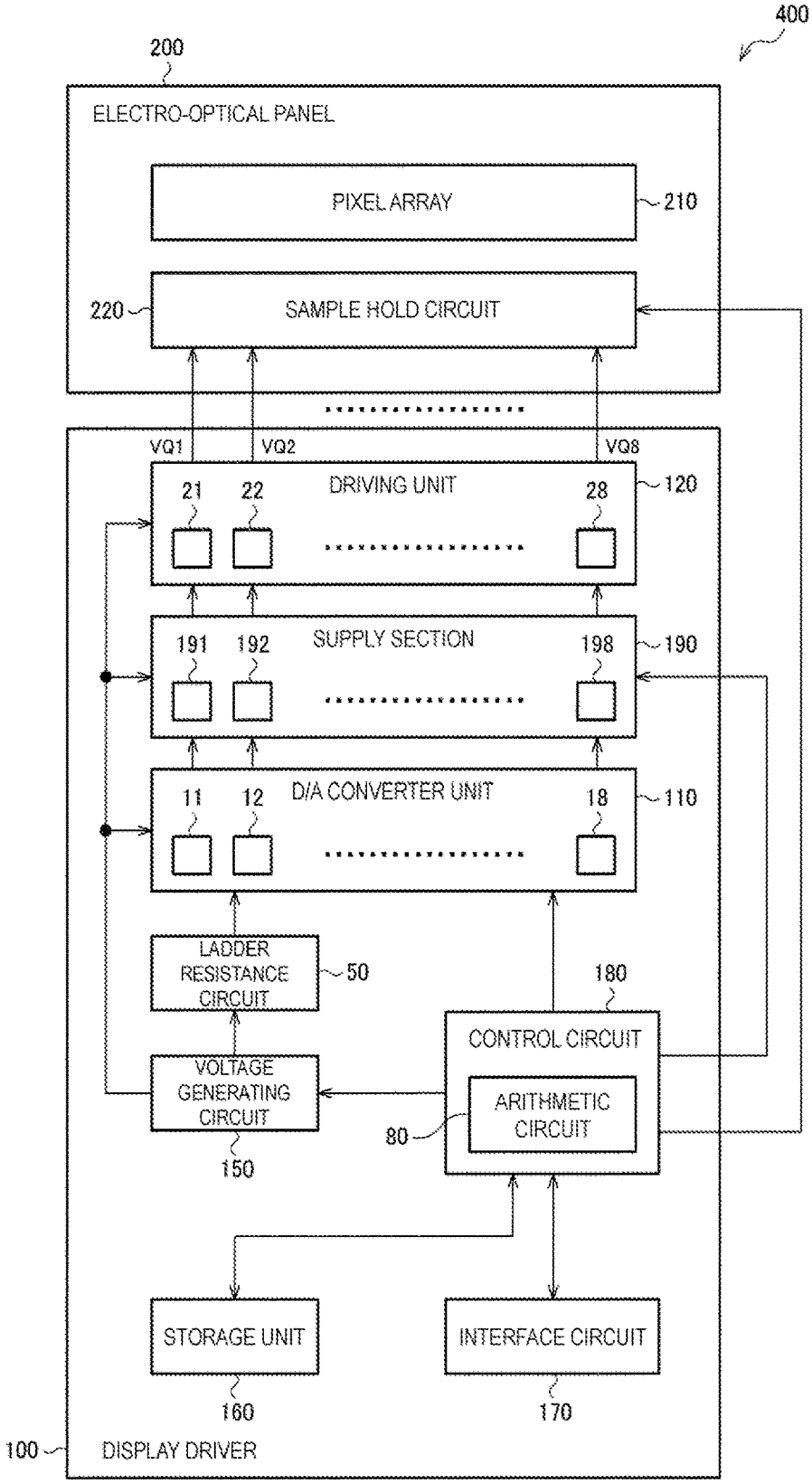
FIG. 15 is an example of a configuration of an electro-optical device.

FIG. 15 is an example of a configuration of an electro-optical device 400 including the display driver 100 in one exemplary embodiment. The electro-optical device 400 (display device) includes the display driver 100 and an electro-optical panel 200 (display panel). Note that a case where the display driver 100 performs phase development driving will be described as an example below. However, an application target of the disclosure is not limited to this, and the disclosure is also applicable to, for example, multiplex driving (demultiplex driving) and the like.

The electro-optical panel 200 includes a pixel array 210 and a sample hold circuit 220 (switch circuit). The electro-optical panel 200 is, for example, a liquid crystal display panel, an electro luminescence (EL) display panel, and the like.

The pixel array 210 includes a plurality of pixels disposed in an array (matrix). In the phase development driving, eight source lines (k source lines in a broad sense. k is an integer of two or more) of the pixel array 210 are successively driven each time. Specifically, the sample hold circuit 220 is a circuit that samples and holds data voltages VQ1 to VQ8 from the display driver 100 to source lines of the pixel array 210. Specifically, the data voltages VQ1 to VQ8 are respectively input to first to eighth data lines of the electro-optical panel 200. It is assumed that the pixel array 210 includes first to 640-th source lines, for example. The sample hold circuit 220 couples the first to eighth data lines to the first to eighth source lines in a first period, and couples the first to eighth data lines to the ninth to sixteenth source lines in a next second period. The same applies to the following, and then the sample hold circuit 220 couples the first to eighth data lines to the 633-th to 640-th source lines in an eightieth period. Such an operation is performed in each horizontal scanning period.

The display driver 100 includes the ladder resistance circuit 50, a D/A converter unit 110 (D/A converter circuit), a driving unit 120 (drive circuit), a supply section 190 (supply circuit), a voltage generating circuit 150, a storage unit 160 (memory), an interface circuit 170, and a control circuit 180 (controller).

Figure 16:
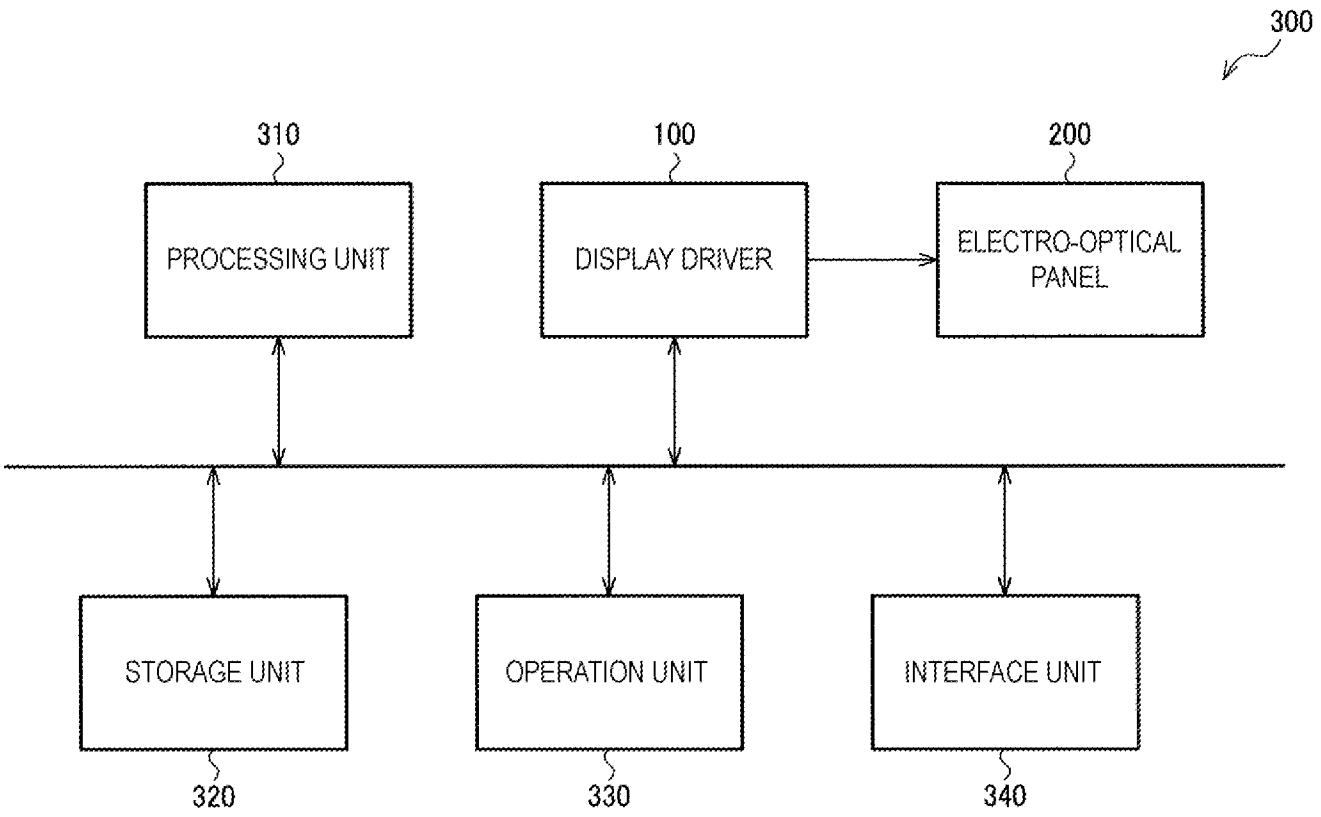
FIG. 16 is an example of a configuration of an electronic apparatus.

The interface circuit 170 performs communication between the display driver 100 and an external processing device (for example, a processing unit 310 in FIG. 16). For example, a clock signal, a timing control signal, and display data are input from the external processing device to the control circuit 180 through the interface circuit 170.

The control circuit 180 controls each unit of the display driver 100 and each unit of the electro-optical panel 200, based on the clock signal, the timing control signal, and the display data input through the interface circuit 170. For example, the control circuit 180 controls display timing such as selection of a horizontal scanning line of the pixel array 210, vertical synchronizing control of the pixel array 210, and control of phase development driving (the above-mentioned first to eightieth periods), and then controls the D/A converter unit 110 and the supply section 190 according to the display timing. The control circuit 180 can also include the arithmetic circuit 80 that computes the setting data CAS for setting a current value of the auxiliary current IAS or an amount of electrical charge of the auxiliary electrical charge QAS. The control circuit 180 can further include the arithmetic circuit 60 that computes the setting data CTP [6:0] and CTM [6:0] for setting a current value of the compensation currents ICM and ICP, respectively.

The voltage generating circuit 150 generates various voltages and outputs the voltage to the driving unit 120 and the D/A converter unit 110. For example, the voltage generating circuit 150 generates a power source of the D/A converter unit 110, the current compensating unit 130, and the driving unit 120. The voltage generating circuit 150 is configured by, for example, a regulator and the like.

The D/A converter unit 110 includes D/A converter circuits 11 to 18. Each of the D/A converter circuits 11 to 18 has the same configuration as the configuration of the D/A converter circuit 10 described with reference to FIG. 1 and the like. The driving unit 120 includes amplifier circuits 21 to 28 (drive circuits). Each of the amplifier circuits 21 to 28 has the same configuration as the configuration of the amplifier circuit 20 described with reference to FIG. 1 and the like. The D/A converter circuits 11 to 18 convert display data from the control circuit 180 from digital to analog and respectively output the voltage converted from digital to analog to the amplifier circuits 21 to 28. The amplifier circuits 21 to 28 invert and amplify the voltage from the D/A converter circuits 11 to 18 and then respectively output the data voltages VQ1 to VQ8 to the electro-optical panel 200.

The supply section 190 includes supply circuits 191 to 198. Each of the supply circuits 191 to 198 has the same configuration as the configuration of the supply circuit 90 described in FIG. 1 and the like. The supply circuits 191 to 198 supply an auxiliary current or an auxiliary electrical charge to input nodes of the amplifier circuits 21 to 28 in the auxiliary period.

The storage unit 160 stores various pieces of data (for example, setting data) used for controlling the display driver 100 and the like. For example, the storage unit 160 is configured by a non-volatile memory and RAM (such as SRAM and DRAM).

9. Electronic Apparatus

FIG. 16 is an example of a configuration of an electronic apparatus 300 including the display driver 100 in one exemplary embodiment. As specific examples of the electronic apparatus 300, various electronic apparatuses in which a display device is installed can be assumed, such as a projector, a head-mounted display, a mobile information terminal, a vehicle-mounted device (for example, a meter panel, a car navigation system, and the like), a portable game terminal, and an information processing device.

The electronic apparatus 300 includes a processing unit 310 (for example, a processor such as a CPU, a display controller, or an ASIC), a storage unit 320 (for example, a memory, a hard disk, and the like), an operation unit 330 (operation device), an interface unit 340 (interface circuit, interface device), the display driver 100, and the electro-optical panel 200.

The operation unit 330 is a user interface that receives various operations from a user. For example, the operation unit 330 is a button, a mouse, a keyboard, and a touch panel attached to the electro-optical panel 200, and the like. The interface unit 340 is a data interface that inputs and outputs image data and control data. For example, the interface unit 340 is a wired communication interface such as a USB or a wireless communication interface such as a wireless LAN. The storage unit 320 stores data input from the interface unit 340. Alternatively, the storage unit 320 functions as a working memory of the processing unit 310. The processing unit 310 processes display data input from the interface unit 340 or stored in the storage unit 320 and then transfers the display data to the display driver 100. The display driver 100 displays an image on the electro-optical panel 200, based on the display data transferred from the processing unit 310.

For example, in a case where the electronic apparatus 300 is a projector, the electronic apparatus 300 further includes a light source and an optical device (for example, a lens, a prism, a mirror, and the like). In a case where the electro-optical panel 200 is transmissive, the optical device causes light from the light source to enter the electro-optical panel 200, and projects light passing through the electro-optical panel 200 onto a screen (display section). In a case where the electro-optical panel 200 is reflective, the optical device causes light from the light source to enter the electro-optical panel 200, and projects light reflected by the electro-optical panel 200 onto the screen (display section).

Note that although some exemplary embodiments are described above in detail, it can be easily understood by those skilled in the art that many modifications can be achieved without substantially departing from inventive matters and effects of the disclosure. Therefore, all of the modified examples are assumed to be included within the scope of the disclosure. For example, a term described with a different term in a broad sense or in the same sense at least once in the description or the drawings can be replaced with the different term in any places of the description or the drawings. Further, all combinations of some exemplary embodiments and the modified examples are also included within the scope of the disclosure. The configurations, the operations, and the like of the display driver, the electro-optical panel, the electro-optical device, and the electronic apparatus are not limited to those described in the disclosure, and various modifications can be achieved.

What is claimed is:

1. A display driver comprising:

a D/A converter circuit configured to convert display data into a gradation voltage;

an inverting amplifier circuit configured to be input the gradation voltage to an inverting input terminal of the inverting amplifier circuit and a reference voltage to a noninverting input terminal of the inverting amplifier circuit, invert and amplify the gradation voltage based on the reference voltage and output data voltage; and a supply circuit configured to supply an auxiliary current or an auxiliary electrical charge to the inverting input terminal of the amplifier circuit, wherein in a non-auxiliary period, the D/A converter circuit outputs the gradation voltage to the inverting input terminal of the inverting amplifier circuit, and in an auxiliary period before the non-auxiliary period, an impedance between an output of the D/A converter circuit and the inverting input terminal of the inverting amplifier circuit is in a high impedance state, and the supply circuit supplies the auxiliary current or the auxiliary electrical charge to the inverting input terminal of the inverting amplifier circuit to approach a voltage of the inverting input terminal to the gradation voltage.

2. The display driver according to claim 1, wherein the inverting amplifier circuit includes a first resistor provided between an output node of the D/A converter circuit and the inverting input terminal, and a second resistor provided between an output terminal of the inverting amplifier circuit and the inverting input terminal.

3. An electro-optical device comprising:

the display driver according to claim 2; and an electro-optical panel driven by the display driver.

4. An electronic apparatus comprising the display driver according to claim 2.

5. The display driver according to claim 1, wherein the supply circuit includes first to n-th capacitors (n is an integer of two or greater) with first ends electrically coupled to the inverting input terminal, and first to n-th buffers configured to output first to n-th voltages to second ends of the first to n-th capacitors by input data based on the display data, and in the auxiliary period, the first to n-th buffers respectively output the first to n-th voltages, and the auxiliary electrical charge is supplied from the first ends of the first to n-th capacitors to the inverting input terminal.

6. The display driver according to claim 5, further comprising:

an arithmetic circuit configured to compute the input data based on the display data and output the input data to the first to n-th buffers.

7. An electro-optical device comprising:

the display driver according to claim 5; and an electro-optical panel driven by the display driver.

8. An electronic apparatus comprising the display driver according to claim 5.

9. The display driver according to claim 1, wherein the supply circuit includes a first current supply circuit provided between a node of a high electric potential and the inverting input terminal and configured to supply the auxiliary current from the node of the high electric potential to the inverting input terminal in the auxiliary period, and a second current supply circuit provided between a node of a low electric potential and the inverting input terminal and configured to supply the auxiliary current from the node of the low electric potential to the inverting input terminal in the auxiliary period.

10. The display driver according to claim 9, wherein the inverting amplifier circuit includes a first resistor provided between an output mode of the D/A converter circuit and the inverting input terminal, and a second resistor provided between an output terminal of the inverting amplifier circuit and the inverting input terminal.

11. An electro-optical device comprising:

the display driver according to claim 10; and an electro-optical panel driven by the display driver.

12. An electronic apparatus comprising the display driver according to claim 10.

13. An electro-optical device comprising:

the display driver according to claim 9; and an electro-optical panel driven by the display driver.

14. An electronic apparatus comprising the display driver according to claim 9.

15. The display driver according to claim 1, wherein the D/A converter circuit includes a switch group configured to select any of a plurality of voltages as the gradation voltage, and a control circuit configured to control the switch group, based on the display data, and the control circuit turns off switches of the switch group to set an output of the D/A converter circuit to the high impedance state in the auxiliary period.

16. An electro-optical device comprising:

the display driver according to claim 1; and an electro-optical panel driven by the display driver.

17. An electronic apparatus comprising the display driver according to claim 1.

18. A display driver comprising:

a D/A converter circuit configured to convert display data into a gradation voltage;

an amplifier circuit configured to be input the gradation voltage to an input node of the amplifier circuit, and output data voltage; and a supply circuit configured to supply an auxiliary current or an auxiliary electrical charge to the input node of the amplifier circuit, wherein the supply circuit includes a first current supply circuit and a second current supply circuit, the first current supply circuit is provided between a node of a high electric potential and the input node of the amplifier circuit, and the second current supply circuit is provided between a node of a low electric potential and the input node of the amplifier circuit, in a non-auxiliary period, the D/A converter circuit outputs the gradation voltage to the input node of the amplifier circuit, and in an auxiliary period before the non-auxiliary period, an impedance between an output of the D/A converter circuit and the input node of the amplifier circuit is in a high impedance state, and the supply circuit supplies the auxiliary current or the auxiliary electrical charge to the input node of the amplifier circuit to approach a voltage of the input node to the gradation voltage.

19. An electro-optical device comprising:

the display driver according to claim 18; and an electro-optical panel driven by the display driver.

20. An electronic apparatus comprising the display driver according to claim 19.

* * * * *